US006945780B2

(12) United States Patent
Perry

(10) Patent No.: US 6,945,780 B2
(45) Date of Patent: Sep. 20, 2005

(54) INTEGRATED PERFORMANCE SIMULATION SYSTEM FOR MILITARY WEAPON SYSTEMS

(75) Inventor: John S. Perry, Afton, MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 09/824,512

(22) Filed: Apr. 2, 2001

(65) Prior Publication Data

US 2002/0142267 A1 Oct. 3, 2002

(51) Int. Cl.[7] ..... F41A 33/00

(52) U.S. Cl. ..... 434/11; 434/11; 434/29; 703/13; 706/15; 706/45

(58) Field of Search ..... 434/11; 703/13, 703/22; 706/45, 47, 15, 21–22; 714/26; 717/100, 104, 151

(56) References Cited

U.S. PATENT DOCUMENTS

| | | | | | |
|---|---|---|---|---|---|
| 4,705,477 | A | | 11/1987 | Komorowski et al. | |
| 4,926,362 | A | | 5/1990 | Carns et al. | |
| 5,042,743 | A | * | 8/1991 | Carney | 244/3.11 |
| 5,303,170 | A | | 4/1994 | Valko | |
| 5,415,548 | A | | 5/1995 | Adams | |
| 5,427,531 | A | | 6/1995 | Kramer | |
| 5,661,668 | A | * | 8/1997 | Yemini et al. | 364/550 |
| 5,719,797 | A | * | 2/1998 | Sevachko | 364/578 |
| 5,844,819 | A | | 12/1998 | Fujinuma | |
| 6,067,415 | A | * | 5/2000 | Uchihira | 717/131 |
| 6,167,360 | A | | 12/2000 | Erickson et al. | |
| 6,208,955 | B1 | * | 3/2001 | Provan et al. | 703/20 |
| 6,411,945 | B1 | * | 6/2002 | Nakajima | 706/19 |

FOREIGN PATENT DOCUMENTS

WO WO 0023934 4/2000

OTHER PUBLICATIONS

Gilmer, John B. Jr., Sullivan, Frederick J. Multitrajectory Simulation Performance for Varying Scenario Sizes, Wlnter 1999 Simulation Conference, pp. 1137–1146.*

Proctor, Dr. Michael, Lipinski, Michael, Technical Performance Measures and Distributed–Simulation Training Systems, Winter 2000, pp. 19–32, www.dau.mil/pubs/arq/2000arq/proctor.pdf.*

Dubin, Henry; Sebastiani, Lambert; Staniec, Cyrus. High Performance Computing Workshop 1999 "Integrated Modeling and Slmulation into the US Army Operational Test and Evaluation Process" 1998, pp. 1–9. www.dtc.army.mil/hpcw/1998/sebast/sebast.html.*

(Continued)

*Primary Examiner*—Xuan M. Thai
*Assistant Examiner*—Cameron Saadat
(74) *Attorney, Agent, or Firm*—Patterson, Thuente, Skaar & Christensen, P.A.

(57) ABSTRACT

An integrated evaluation and simulation system interactively evaluates concept design decisions and design requirements in the context of an operational weapon system. The combat effectiveness of a weapon system may also be concurrently tested by virtual simulation. A computer system is programmed to implement a causal network model comprising an integrated collection of analysis models for creating a virtual representation of a weapon system. The integrated evaluation and simulation system includes a user interface operably coupled to at least the computer system to selectively input data into the causal network model and receive information from the causal network model and at least one virtual simulation system. The system further includes either a virtual simulation system operably coupled to the causal network model or, as part of the computer system, a virtual simulation system interface to communicate with a virtual simulation system.

14 Claims, 20 Drawing Sheets

OTHER PUBLICATIONS

Carico, Dean. High Performance Computing Workshop 1998 "Flight Test Automation Using High Performance Computing" Naval Air Warfare Center Aircraft Division. 1998, pp. 1–9. www.dtc.army.mil/hpcw/1998/carico/carico.html.*

Jackson, Bruce E. NASA Technical Memorandum 110164 Manual for a workstation–based Generic Flight Simulation Program (LaRCsim) Version 1.4, E. Langley Research Center. Virginia, Apr. 1995. www.techreports.larc.nasa.gov/ltrs/PDF/NASA–95–tm110164.pdf.*

Jackson, Bruce E. AIAA 95–3414 Results of a Flight Slmulation Software Methods Survey. Langley Research Center, Aug. 7–9, www.techreports.larc.nasa.gov/ltrs/ PDF/NASA–aiaa–95–3414.pdf.*

Wingfield, S.L.: Venema, T.L.: □□Aerospace and Electronics Conference. 1994. NAECON 1994., Proceedings of the IEEE 1994 National , May 23–27, 1994 □□ Page(s): 1200–1207 vol. 2.*

Allred, L.G.; □□Aerospace and Electronics Conference, 1990. NAECON 1990., Proceedings of the IEEE 1990 National , May 21–25, 1990 □□Page(s): 359–361 vol. 1.*

Gaston, G.J.; □□Advanced MOS and Bi–Polar Devices, IEE Colloquium on , Feb. 14, 1995 □□Page(s): 17/1–17/6.*

*Executing the DoD Modeling and Simulation Strategy–Making Simulation Systems of Systems a Reality*, James W. Hollenbach, William L. Alexander, Proceedings of the 1997 Winter Simulation Conference, pp. 948–954, 1997.

*An Example of Simulation Use in Army Weapon System Development*, Ann H. Kissell, Proceedings of the 1999 Winter Simulation Conference, pp. 1079–1087, 1999.

*System Concept Development With Virtual Prototyping*, James C. Schaaf, Jr., Proceedings of the 1997 Winter Simulation Conference, pp. 941–947, 1997.

*Advanced Simulation, Battle Managers, and Visualization*, Joseph J. Molitoris, Thomas D. Taylor, Proceedings of the 1995 Winter Simulation Conference, pp. 1168–1175, 1995.

*Modeling and Stimulation Enabling Technologies for Military Applications*, Alex S. Sisti, Steven D. Farr, Proceedings of the 1996 Winter Simulation Conference, pp. 877–883, 1996.

*Exploring Temporal Uncertainty in Parallel and Distributed Simulations*, Richard M. Fujimoto, Georgia Institute of Technology, IEEE, pp. 46–53, 1999.

*An Integrated Approach to System Modeling Using a Synthesis of Artificial Intelligence, Software Engineering and Simulation Methodologies*, Paul A. Fishwick, University of Florida, ACM Transactions on Modeling and Computer Simulation, vol. 2, No. 4, pp. 307–330, Oct. 1992.

Web site print–out: *EPG Assets, the C41 Synthetic Battlefield Environment Lab* (*C41 SBEL*), 2 pgs., 2001.

Web site print–out: *EPG Assets, the Virtual Electronic Proving Ground* (*VEPG*), 2 pgs., 2001.

* cited by examiner

GROUNDWARS OUTPUT

GROUNDWARS SUMMARY

| | | | |
|---|---|---|---|
| BLUE VEHICLES | 4.000 | RED VEHICLES | 8.000 |
| BLUE VEHICLES KILLED | 3.372 | RED VEHICLES KILLED | 5.669 |
| FORCE EXCHANGE RATIO | 0.841 | LOSS EXCHANGE RATIO | 1.681 |

INTEGRATED PERFORMANCE SIMULATION SYSTEM FOR MILITARY WEAPON SYSTEMS

FIELD OF THE INVENTION

The present invention relates generally to the field of simulations for military weapon systems. In particular, the present invention relates to a system for aiding the design work of complex military weapon systems by performing sophisticated design concept analysis and simulated operations on virtual representations of weapon systems interactively with the design work by utilizing a causal network methodology to allocate constrained resources for optimizing weapon system performance.

BACKGROUND OF THE INVENTION

The development of complex military equipment has traditionally been based on a rigid, top-down approach, originating with the publication of a customer operational requirements document. The prime contractor decomposes the operational requirements document to allocate requirements at a weapon system level, which in turn are further decomposed and allocated at the subsystem and component level. This top-down hierarchical approach ensures that customer requirements are reflected in lower-level requirements and become integral to the objective weapon system design. This approach, however, does very little for optimally allocating limited resources across the weapon system so that a desired capability is optimized. Objective characteristics of the operational design often exceed program constraints. In addition to the resulting suboptimized designs, this top-down approach leads to misallocated development resources and an inability for the development process to rapidly respond to the inevitable changes in operational, fiscal, and technological considerations.

Customer recognition of the dilemma described above and the reality of tight fiscal budgets have had a noticeable philosophical change on the way future weapon systems can be developed and procured. The development of future weapon systems will be cost constrained and a weapon system's capabilities will be driven by the customer's ability to procure funding. In addition, the geopolitical landscape has radically changed during the past decade, so that most forces are no longer forward deployed, but rather are forward deployable. The ability to project force around the world, and the ability to sustain a force outside a customer's sovereign territory, has placed a tremendous burden on the logistical operations of customers. For example, providing fuel to an extended force is by far the largest burden on logistics. This demand can be cut significantly by reducing the weight of the military equipment. The size of military equipment also has a significant effect on the ability to carry or transport and to use the equipment. The need for lighter, smaller equipment has, in essence, elevated the importance of weapon system weight to the same level as weapon system cost. Total weapon system cost and weight have become limiting resources in the development of future military weapon systems.

In response to the changing fiscal and geopolitical environment, some customers have established a mission need and a partial list of non-negotiable operational requirements for future weapon systems. These customers have requested that prospective weapon system developers design, develop, and demonstrate a credible simulated modeling approach to satisfying operational and weapon system requirements and to developing weapon system designs that allocate constrained resources and optimize performance according to specified measures of effectiveness.

Previous efforts to develop software for weapon systems have focused on stand alone simulation software or software that provides analysis at the subsystem or component level only, because methods such as the top-down approach described above were used to manage the overall design and development process. For example, U.S. Pat. No. 4,926,362, entitled Airbase Sortie Generation Analysis Model (ABSGAM), describes a computer simulation model whose objective is to analyze the sortie generation capabilities and support requirements of air vehicle designs and to perform effectiveness analyses on these designs. The model cannot be used to allocate resources across the system or various subsystems or components of the design nor used concurrently and interactively to analyze design work. Another similar invention is described in U.S. Pat. No. 5,415,548, entitled System and Method for Simulating Targets for Testing Missiles and Other Target Driven Devices.

It would be advantageous to have an evaluation and simulation system that functioned integrally with the conceptualization, design, and development of complex military weapon systems under conditions whereby design concepts can be analyzed, constrained resources can be allocated across a weapon system architecture in a manner that optimizes the weapon system's combat effectiveness, and a virtual representation of the weapon system can be tested under simulated combat conditions for combat effectiveness. Moreover, it would be advantageous to allow the user of such an evaluation and simulation system to establish performance levels for operational, system, subsystem, and component requirements, while optimizing the weapon system's combat effectiveness and satisfying the resource constraints.

SUMMARY OF THE INVENTION

The present invention provides an integrated evaluation and simulation system to concurrently and interactively evaluate the benefits and burdens of concept design decisions and design requirements in the context of an operational weapon system. The combat effectiveness of a weapon system built according to a set of design parameters may also be concurrently tested by virtual simulation. The integrated evaluation and simulation system enables a system designer to efficiently, comprehensively, interactively, and concurrently evaluate and optimize overall weapon system performance by manipulating basic system design inputs and parameters. The system is easily adapted to a wide variety of analyses both with respect to current and future assumptions and environments, including sensitivity and trade-off analysis, dependencies analysis, and optimization analysis based on predetermined resource constraints.

The integrated evaluation and simulation system includes a computer system programmed to implement a causal network model comprising an integrated collection of analysis models, preferably of high fidelity, for analyzing design concepts and creating a virtual representation of a weapon system. The system also includes a user interface operably coupled to at least the computer system to selectively input data into the causal network model and receive information from the causal network model and a virtual simulation system. The integrated evaluation and simulation system further includes either at least one virtual simulation system operably coupled to the causal network model or, as part of the computer system, a virtual simulation system interface operably coupled to the causal network model and at least one virtual simulation system. A virtual simulation system may include an operation simulator to simulate operations of a weapon system and an effectiveness simulator to analyze the effectiveness of the weapon system in a simulated operational environment. After inputting into the causal network model that data which is necessary for the causal network model to create a virtual representation, the causal network model is pulsed to actually create the representation, which is then sent to a virtual simulation system. Upon receiving the results of a simulation from the virtual simulation system, the user interface communicates this information to a user.

The integrated evaluation and simulation system of the present invention is robust in that it is capable of several modes of operation. A single-run mode propagates specified inputs once through the causal network model. A dependencies mode identifies all downstream parameters that are dependent upon any specified input parameter. A sensitivities mode provides a venue for performing sensitivity and/or trade-off analysis between any of the variables within the causal network model. An optimization mode locally or globally optimizes the combat effectiveness of a weapon system as a function of specified performance requirements and constrained resources.

The architecture of the preferred embodiment of the present invention includes a user interface, preferably having a menu driven graphical user interface, a virtual simulation system interface, a causal network model of a weapon system being studied, a control system, and at least one virtual simulation system. The user interface is most visible, as it provides the command line or "windows" for a user to supply data and receive information. The user interface provides the interface mechanisms to manipulate the causal network model to explore the interrelationships within the weapon system being studied. The user interface also provides the interface mechanisms to control the functions of the integrated evaluation and simulation system, such as performing sensitivity and/or trade-off analysis, dependencies analysis, or optimization analysis, and controlling the various modes of operation of the integrated evaluation and simulation system.

The virtual simulation system interface acts as a collection location and bi-directional interface for distributing data and information to and from a virtual simulation system. As a collection point, the interface receives the data and information streams flowing from the causal network model, the user interface, the control system, and the virtual simulation system. The interface distributes data and information to the virtual simulation system and from the virtual simulation system to the user interface and control system. The interface may be a separate module or may be incorporated into one or more other elements of the integrated evaluation and simulation system, and can be interfaced via communication channels, data arrays, or input file structures with the virtual simulation system.

The causal network model is the "computational brain" of the integrated evaluation and simulation system via an integrated collection of analysis models. Causal network methodology provides a way to diagram the elements and interrelationships among the elements that comprise the weapon system being studied. Once created, the causal network diagram is used as a blueprint to develop the mathematical models and computer source code that are used to model the weapon system. By using a separate, modular subroutine for each "node" in the causal network model, the integrated evaluation and simulation system can be modified and upgraded easily as the fidelity of the model increases over its life-cycle.

The causal network model contains a relational database of the "network", including the "nodes" that define the complex interactions and interrelationships within the weapon system being studied, for example, between operational and lower-level requirements or between system performance and design attributes, including constrained resources. The causal network model performs all the computations required by the user interface, the virtual simulation system interface, and the control system. An output of the causal network model is a virtual representation of the weapon system that selectively can be sent to a virtual simulation system. The causal network model is sufficiently detailed to capture subsystem and component level resolution. Each node within the causal network model represents a mathematical "black box" that performs computations and data conversion. These black boxes convert upstream dataflows, parameters that flow into a node, into downstream dataflows, the parameters that flow out of each node.

The benefits of the integrated evaluation and simulation system with its incorporation of causal network methodology are many. First, this technique provides a quick and simple way to diagram the elements and interrelationships among elements that compose a weapon system being studied. This visual technique greatly simplifies efforts to identify elusive relationships within the weapon system. Second, once created, the causal network diagram can be used as a blueprint for developing the mathematical models and computer source code that are used to create a virtual representation of the weapon system. Finally, the causal network diagram and its computer model analogue can be easily modified and upgraded as the model's fidelity increases over its life-cycle. When an individual submodel is identified as below the mean fidelity of the causal network model, this less robust submodel easily can be removed and replaced with an upgraded version. Thus, as the development of a concept progresses, more information becomes available within the design space. This information can then be used to improve the submodels affected by the upgraded version, thereby providing a means to integrally improve the overall model. This, in turn, results in higher resolution analyses and even more information for further improvement of the model. If this approach is followed through the design cycle of a weapon system concept, the design model eventually evolves from a rapid prototype evaluator into a simulator for the actual weapon system.

The control system may be adjunct to the causal network model although preferably it is separate from the causal network model. The control system consists of the logical algorithms necessary to pulse the causal network model and to control the analysis processes. For example, the control system is used to control the execution of sensitivity analysis by stimulating a desired input parameter and measuring the response at any downstream parameter. In dependencies analysis, the control system is used to identify parameters within the causal network model that are downstream relative to any upstream input parameter. In optimization analysis, the control system will provide a user with the ability to locally or globally optimize across one (or many) input parameter(s) to determine the best mix of design parameters that meet specified constraints while optimizing combat effectiveness.

The integrated evaluation and simulation system of the present invention may be applied to the design and optimization of a wide variety of weapon systems. In one embodiment, the present invention is applied to the design of a ground combat vehicle. In another embodiment, the present invention is applied to the design of a naval gun system. In each case, the integrated evaluation and simulation system allows for the performance of sophisticated design concept analysis and simulated operations on virtual representations of the weapon systems interactively with the design work in such a way as to allocate constrained resources for optimizing weapon system performance.

DESCRIPTION OF THE PREFERRED EMBODIMENT

The preferred embodiment of the invention implements a requirements analysis computer system, that addresses the fundamental question regarding how to allocate limited resources, such as cost and weight resources, across a system architecture of complex military equipment in a manner that optimizes the weapon system's combat effectiveness. The integrated evaluation and simulation system allows a user to establish performance levels for operational, system, subsystem, and component requirements, leading to an optimal equipment design, as measured by the weapon system's combat effectiveness and given the resource constraints. The integrated evaluation and simulation system is capable of concurrently and interactively modeling the performance and constrained resource parameters of a weapon system and simulating the weapon system's combat effectiveness on a virtual simulation system. The integrated evaluation and simulation system implements a modular software architecture down to the equipment component level and can be operated by selectively using a menu driven graphical user interface.

The integrated evaluation and simulation system preferably can be run in any of four different modes: a single-run mode, which propagates specified inputs once through the causal network model; a dependencies mode, which identifies all parameters downstream from any input parameter; a sensitivities mode, which provides a venue for performing sensitivity and trade-off analysis between any variables within the causal network model; and an optimization mode, which optimizes combat effectiveness for specified constrained resources at the local or global level, i.e., the component, subsystem, or system levels. The integrated evaluation and simulation system also can perform sensitivity analysis between the operational performance of the weapon system and the system, subsystem, or component requirements; design attributes; or performance attributes of the weapon system. The user interface has a level of user friendliness that is acceptable to engineers, analysts, and project managers. The invention provides easy use, modularity, computational speed, and accurate results.

Figure 1:
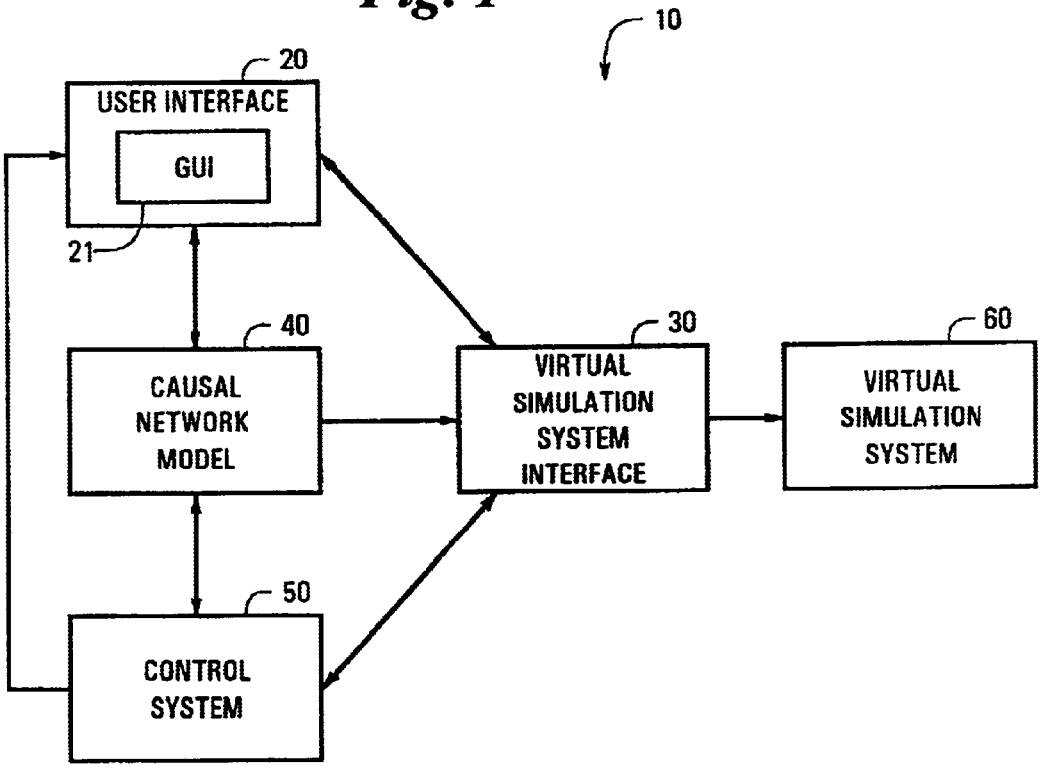
FIG. 1 is a diagram of the system architecture of the integrated evaluation and simulation system.

As shown in FIG. 1, a system architecture 10 of the present invention includes a user interface 20, having a menu driven graphical user interface 21, a virtual simulation system interface 30, a causal network model 40, a control system 50, and at least one virtual simulation system 60. Preferably, the user interface 20 bi-directionally communicates with the virtual simulation system interface 30 and the causal network model 40, the causal network model 40 bi-directionally communicates with the control system 50 and communicates to the virtual simulation system interface 30, the control system 50 bi-directionally communicates with the virtual simulation system interface 30 and communicates to the user interface 20, and the virtual simulation interface 30 bi-directionally communicates with the virtual simulation system 60.

The integrated evaluation and simulation system is based on several performance criteria: usability, modularity, speed, and accuracy. Usability is defined as the level of accessibility to input data and output information, and the level of user friendliness of the user interface design. All input and output is accessible to the user via a graphical user interface 21 and/or data files. A user is not encumbered with "window confusion," i.e., too many windows open simultaneously, as one embodiment of the present invention allows for no more than six windows to be open concurrently. This was determined to be the maximum number of windows that practically could fit on a 21 inch monitor. In an alternate embodiment, a large projection screen display arrangement is utilized to simultaneously display a much larger number of operational windows via the graphical user interface 21, together with an animated presentation of the progress and/or results of the simulation system 60.

The integrated evaluation and simulation system is easy to maintain and upgrade because of its modular software design. The software uses a modular subroutine for each "node" within the causal network model 40. This facilitates the maintenance, removal, and replacement of each "black-box" for each node, as the need arises, without disrupting the balance of the system. Commonality exists between a visual representation of the causal network model 40 and the software.

Computational speed is defined for each mode of operation. The computational error of output does not exceed a predetermined percentile for any single computed variable, when compared to actual test data. The predetermined percentiles are based on previous experience in modeling the weapon system under study.

The system architecture 10 includes a computer system having a causal network model 40. The causal network model 40 performs all the computations required by the user interface 20, the virtual simulation system interface 30, and the control system 50 and provides a means for analyzing the complex interactions and interrelationships within the weapon system under study. The causal network model 40 creates a virtual representation of the weapon system under study that encompasses the critical combat effectiveness functional attributes of the weapon system. Each functional attribute is promulgated to a level that supports an assessment of performance and the constrained resources. The causal network model 40 can also create a "threat" virtual representation to "morph" the threat's performance characteristics against a "blue" weapon system, as the blue weapon system's performance characteristics are changed.

The system architecture 10 also includes a user interface 20 a user to control all aspects of the system behavior. A user may selectively control the preferred embodiment either from the command line or through the graphical user interface 21. When the command line is used, a user uses a text editor to directly edit input files as needed. The user then types the appropriate command to run the causal network model 40. Control is returned to the user at the command prompt when the run is completed. When the graphical user interface 21 is used, this interface interacts with the causal network model 40 on behalf of the user. The user interface 20 is a separate software program from the program holding the causal network model 40, as this separation facilitates implementation of the control system 50, especially when the control system 50 utilizes a commercially available optimizer.

As with other parts of the integrated evaluation and simulation system, the graphical user interface 21 is designed to be highly modular and easily modifiable and expandable. Input and output often used within a single working session has its own user interface panel, while input and output that is infrequently accessed, or accessed only after multiple working sessions, is accessible via data files. The graphical user interface detailed design preferably takes the form of a series of panel designs that contain the detail on behavior, functionality, and parameters accessible by the respective panels.

Figure 2:
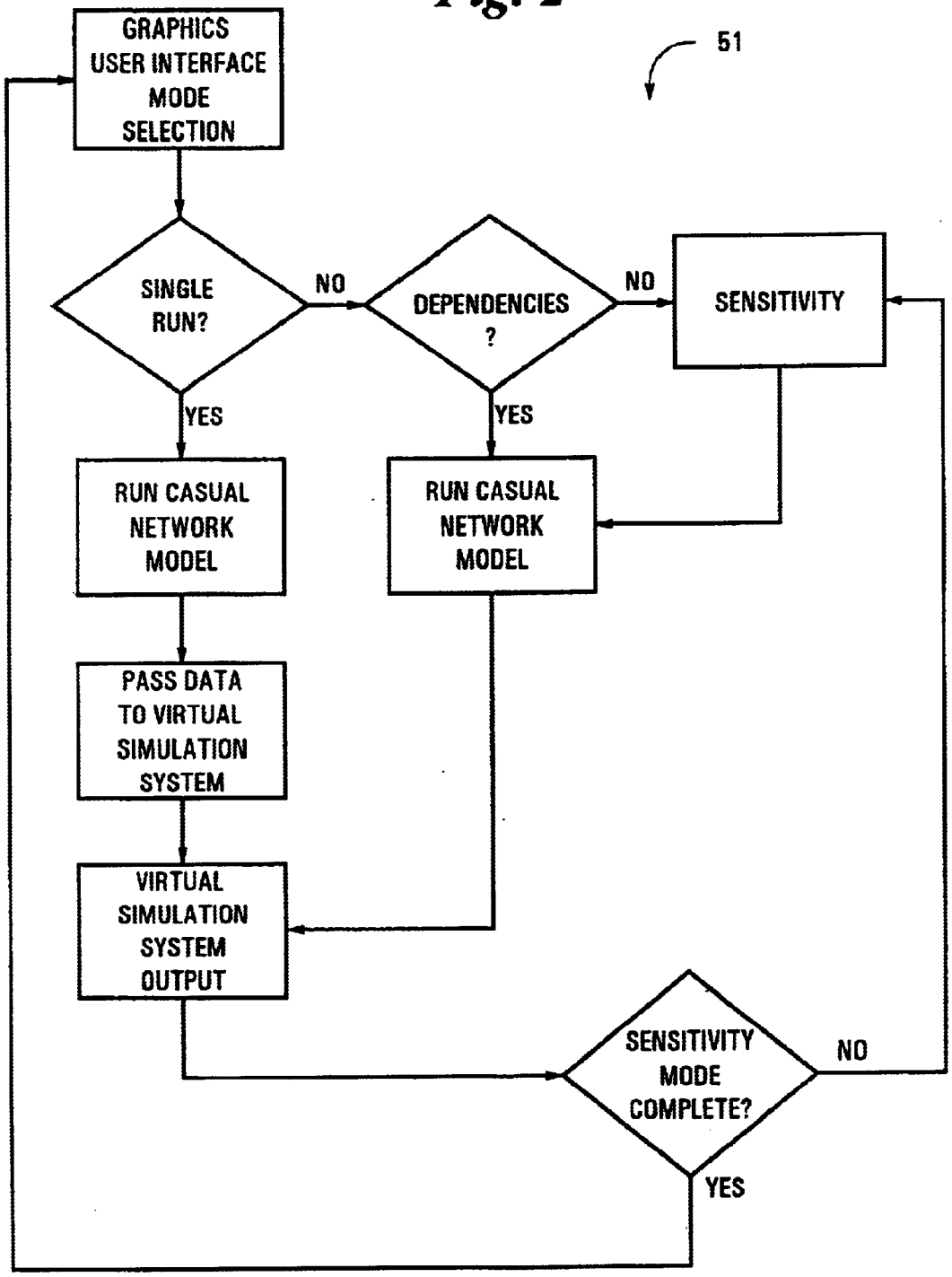
FIG. 2 is a diagram of the control system algorithm of the preferred embodiment.

A control system 50 is used to control the states and modes of operation of the invention and to control the optimization process that operates upon the causal network model 40. The control system 50 is preferably at least partly based on gradient search methodology; and the optimization process may be a commercially available product. A control system algorithm 51, as illustrated in FIG. 2, controls the integrated evaluation and simulation system 10 in the single-run, dependencies, and sensitivities modes of operation. The optimization mode is achieved by using special algorithms to pulse the causal network model 40 until each of the dependent variables converge to within acceptable limits.

A virtual simulation system interface 30 preferably serves as a conduit between the causal network model 40 and a virtual simulation system 60. When the virtual simulation system 60 is provided by a third party, the virtual simulation system interface 30 preferably is configured so that the virtual simulation system 60, other than possibly some driver functions, does not have to be modified. For example, a virtual simulation system interface 30 for ground combat vehicles can be designed to act as a conduit between the causal network model 40 and the United States Army's GroundWars model while preserving GroundWar's accredited status. In addition, the virtual simulation system interface 30 returns data structures from a virtual simulation system 60 to the control system 50 and user interface 20. This information can include a summary of the results of a monte-carlo style simulation, vehicle acquisition statistics, a killer-victim scoreboard, a distribution of shots, and a loss exchange ratio.

The integrated evaluation and simulation system 10 has no adverse affects on its operational environment, including its hardware and software environment. The preferred embodiment of the present invention runs in a UNIX or LINUX operating environment and is accessible from any Sun or Silicon Graphics Incorporated (SGI) workstation; an SGI system is used to generate plots of analysis results. Those skilled in the art are aware that other present and future computing system platforms may be used to support the integrated evaluation and simulation system. The preferred embodiment is capable of creating three-dimensional plots and numerical tables. In an alternate embodiment, sufficient computational power is provided to enable the integrated evaluation and simulation system 10 to display in real time animation the results of the simulation system 60.

Using the graphical user interface 21, the mode of operation selection is made via a mode of operation button on the main menu window. The single-run mode performs a single run through the causal network model 40, producing a set of intermediate and final results. The input variables can be changed one at a time or in any combination. The computational process begins when a run "button" is activated to propagate all of the input data through the entire causal network model 40.

The dependencies mode rapidly and visually identifies the interrelationships between design attributes and performance parameters within the causal network model 40. A user can select any input value and generate visual cues, for example check boxes, of all downstream parameters that would be affected by a change to this input. First, the control system 50 is initiated and the causal network model 40 is pulsed to identify the downstream parameters. Then the results are returned to the user interface 20.

The sensitivities mode is designed to evaluate weapon system performance in terms of any design parameter in the causal network model 40. When this mode is selected, any input design parameter (independent variable) can be varied to evaluate the effects on any performance parameter (dependent variable). The control system 50 performs multiple single-run passes through the causal network model 40, varying the selected input variable according to the range and increment specified by the user. The results of the analysis are presented in an analysis window and selectively can be displayed graphically.

The optimization mode provides for determining the best mix of design parameters that meet specified performance requirements and resource constraints while optimizing a weapon system's combat effectiveness as measured, for example, by loss exchange ratio computations. A user can select which design parameters will be included in the optimization. These selections are used to configure the control system 50 to optimize the combat effectiveness by varying the selected design parameters and satisfying the resource constraints and performance requirements.

The integrated evaluation and simulation system is applicable to any military weapon system, whether air, naval, or ground based. One preferred embodiment implements an integrated evaluation and simulation system for ground combat vehicles. The purpose of the ground combat vehicle embodiment is to design an optimal ground combat vehicle, as measured by the vehicle's combat effectiveness and given specified performance requirements and constraints for cost and weight. This embodiment selectively sends a virtual representation of the weapon system to an accredited GroundWars Combat Effectiveness Model, an ARTQUIK model, or a NATO Reference Mobility Model II (NRMM II) for simulation, without affecting the integrity of these virtual simulation systems. GroundWars is a direct fire force-on-force combat simulation model that can be connected via its data arrays or its input file structure. Because of the complex nature of writing to GroundWars input files, the ground combat vehicle embodiment uses data arrays to pass data and information to GroundWars. ARTQUIK is a simple artillery barrage effectiveness model, and NRMM II is a model that evaluates vehicle mobility across different types of terrain. Those skilled in the art are aware that other virtual simulation systems may be available presently and in the future.

Figure 3:
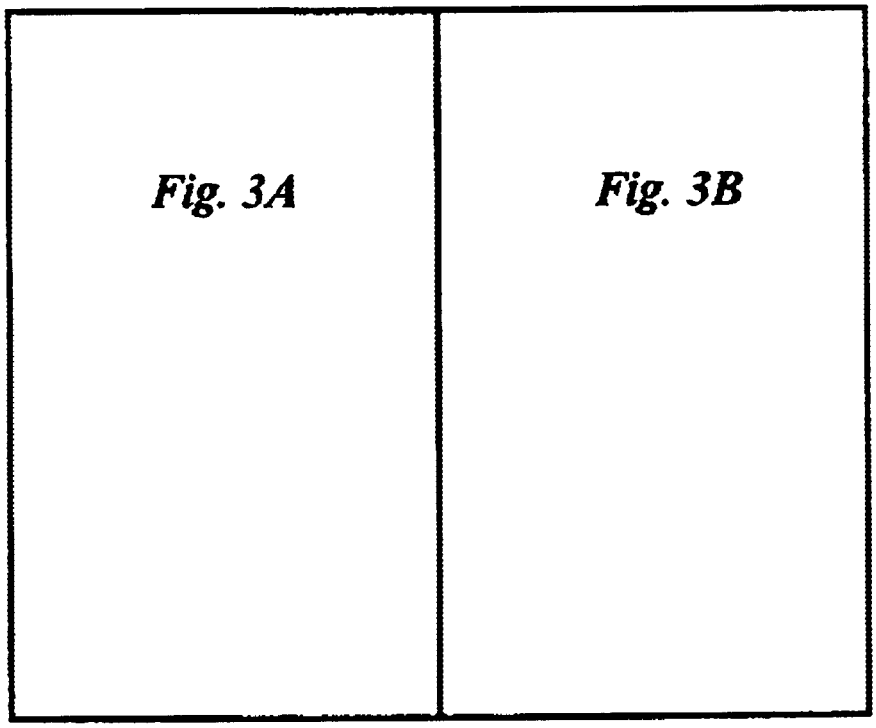
FIG. 3 is a depiction of a breakdown of the components of the system architecture of the preferred embodiment.
Figure 3A:
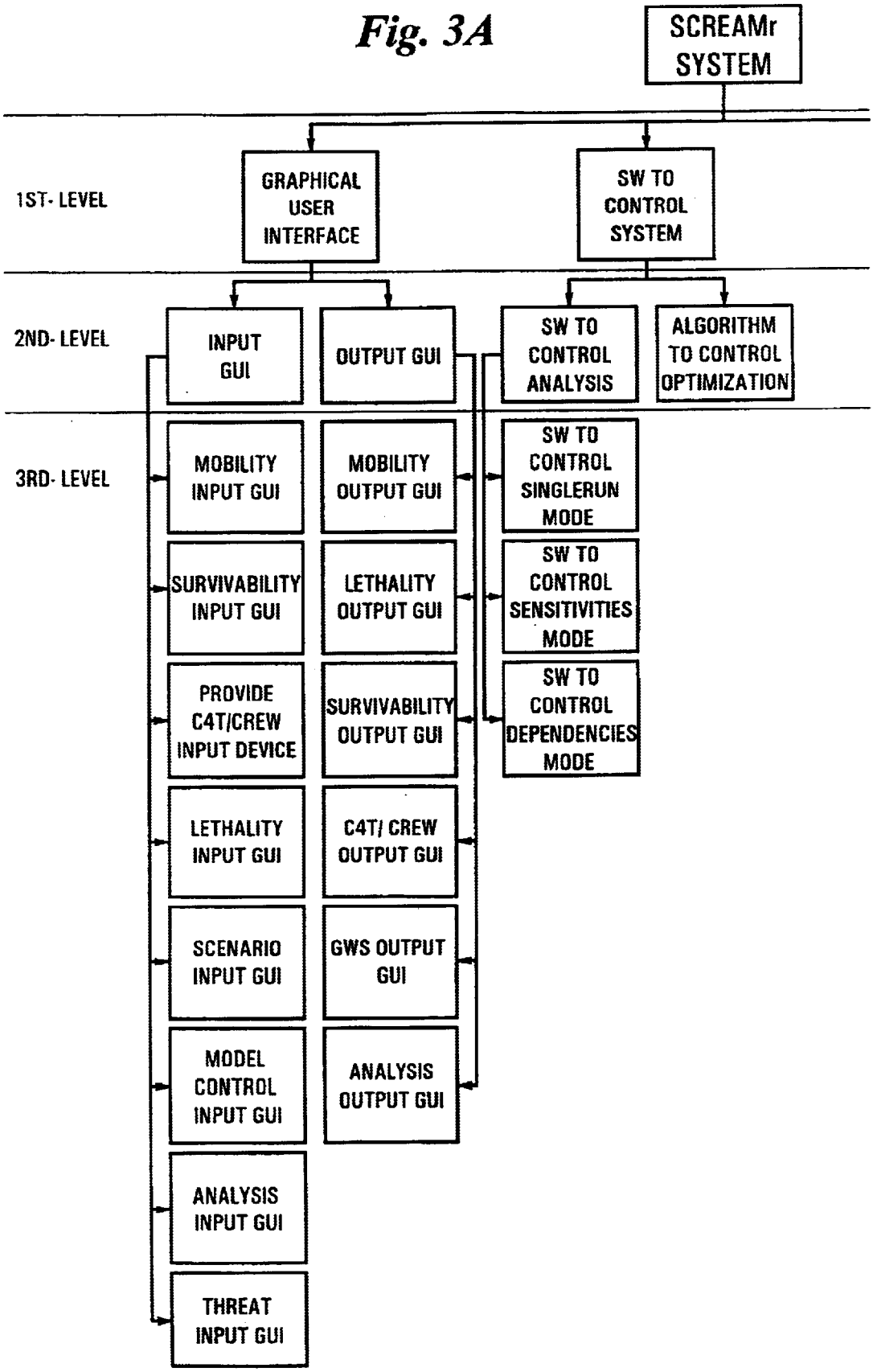
Figure 3B:
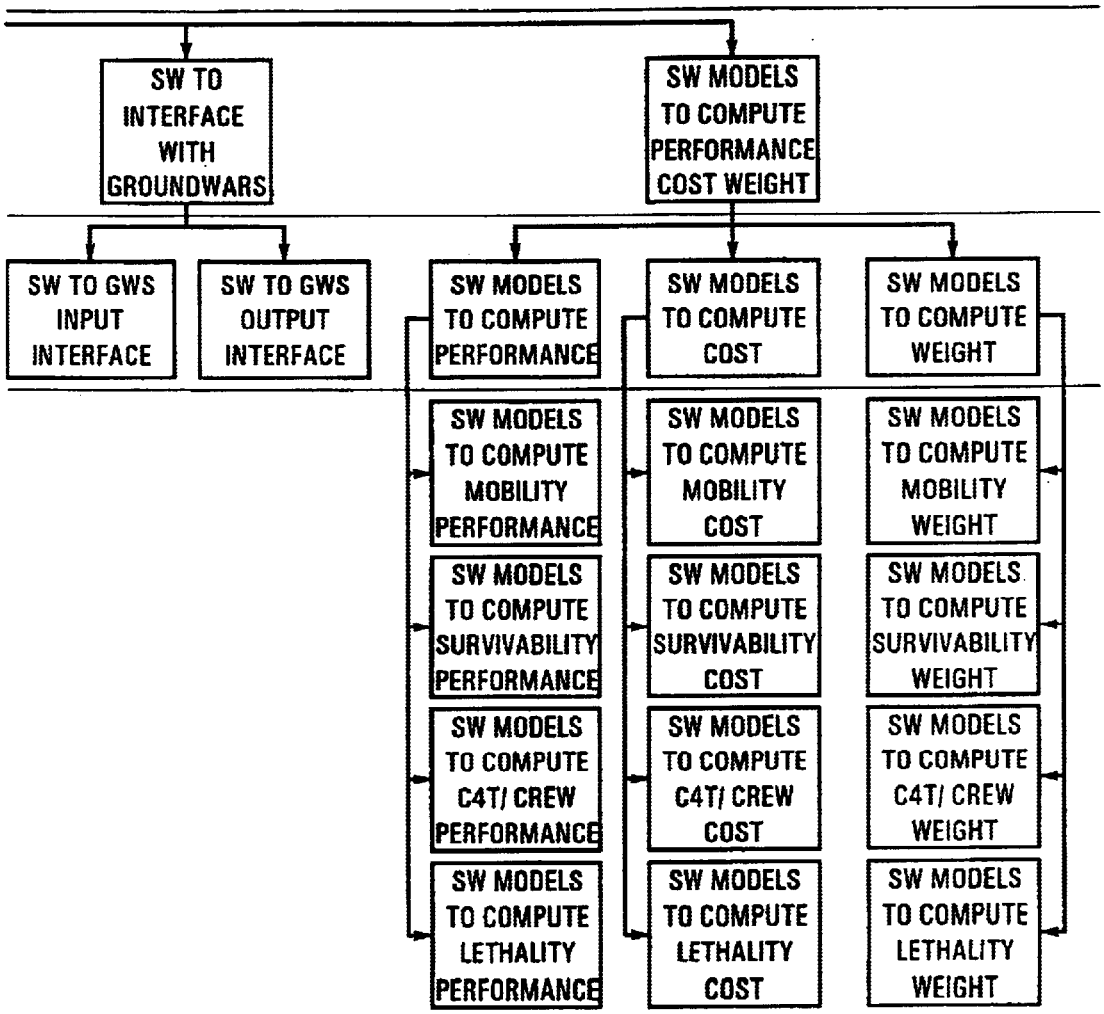

The ground combat vehicle embodiment implements a modular software architecture down to the vehicle component level. FIG. 3 depicts a breakdown of the weapon system for a ground combat vehicle. The second level defines the functional "categories" of the various parts and shows the part to which each is related. The third level provides further detail with respect to each functional category. For example, the control system analysis function is further broken down into control single-run mode, control sensitivities mode, and control dependencies mode.

The computational speed of the ground combat vehicle embodiment is defined for each mode of operation. For the single-run mode, which involves propagating all inputs once through the causal network model and into the virtual simulation system, run times of 2 minutes or less are required. For the dependencies mode, run times of less than 10 seconds are required. For the sensitivities mode, a value of 15 seconds or less is required for nonGroundWars runs that consist of at least 10 increments on the independent variable. For GroundWars runs, a value of 20 minutes or less is required for sensitivities that consist of at least 10 increments on the independent variable. For the optimization mode, run times of 2 days or less are acceptable. These preferred computational times were established based on experience with respect to user acceptance of computational "dwell" time.

Output from a causal network model run preferably includes information to create a three-dimensional visual prototype of the shape of a resulting ground combat vehicle virtual representation, and information about munitions and mobility as well as an overall system summary, accuracy related performance data, exterior ballistics related performance data, a "blue" vehicle's probability of achieving a hit or killing a "threat" vehicle, and a "blue" vehicle's vulnerability to being hit or killed. Output from a GroundWars simulation includes a summary of the results of a monte-carlo style simulation, vehicle acquisition statistics, a killer-victim scoreboard, a distribution of shots, and a loss exchange ratio. This information is available both from the graphical user interface and from the command line. The computational error of the ground combat vehicle embodiment's output preferably does not exceed ten percent for any single variable computed, when compared to actual test data. Ten percent was determined based on previous experience in modeling the performance of ground combat vehicles.

Figure 4:
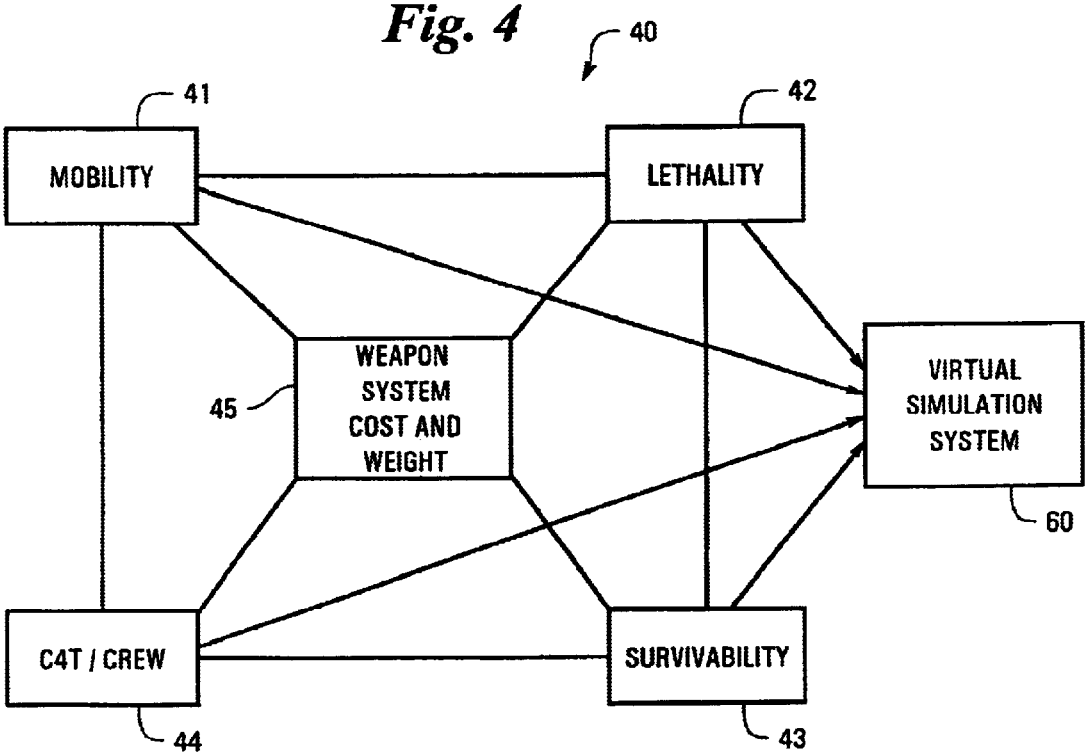
FIG. 4 is a depiction of the causal network model of the preferred embodiment as it is organized around the critical attributes of a ground combat vehicle.
Figure 5:
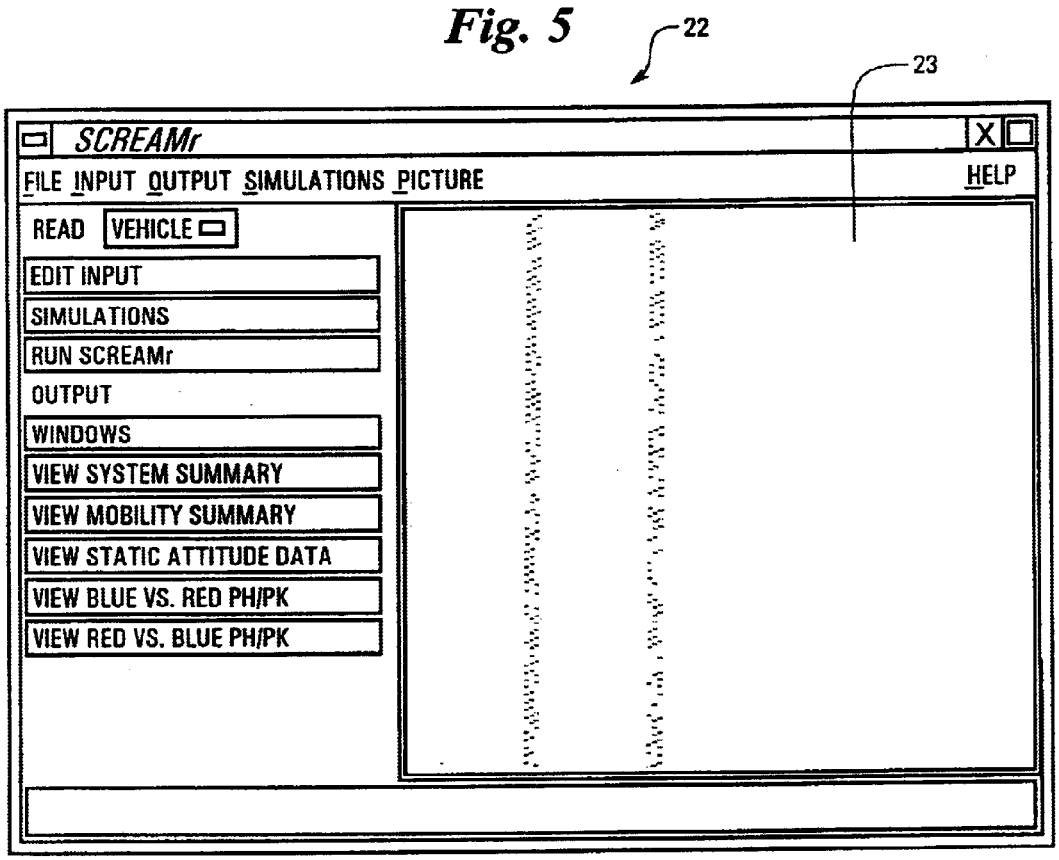
FIG. 5 is an illustration of the main menu window.

As depicted in FIG. 4, the causal network model is implemented around the four functional cornerstones for a ground combat vehicle: mobility 41, lethality 42, survivability 43, and C4I/Crew 44. The mobility cornerstone 41 contains all operational, system, subsystem, and component level performance and design attributes associated with transporting the vehicle through the United States Army's air, rail, road, and sea transportation network, and the vehicle's mobility, under its own power, across prepared roads and cross-country. The lethality cornerstone 42 contains all operational, system, subsystem, and component level performance and design attributes associated with storing, loading, aiming, firing, flying, and penetrating a target with a long rod penetrator. The survivability cornerstone 43 contains all operational, system, subsystem, and component level performance and design attributes associated with not being seen, not being hit, and not being killed. The C4I/Crew 44 cornerstone contains all operational, system, subsystem, and component level performance and design attributes associated with target search, acquisition, engagement timeliness, and engagement doctrine. The causal network model may be further disseminated to capture subsystem and component level resolution. Using this as a basis, the causal network model calculates, for example, the size and mass of a vehicle, the location of the vehicle's center of gravity, the vehicle's moments of inertia, the maximum speed of the vehicle, the vehicle's minimum potential shooting frequency, and the speed of a projectile as it leaves the vehicle's gun barrel.

The operations simulator interface is designed to act as a conduit between the causal network model and the Army's GroundWars model, thereby preserving GroundWar's accredited status. The detailed design of the operations simulation interface includes data structure packets for distributing to the GroundWars simulator the performance parameters necessary for GroundWars operation. These data structures have been structured according to the four functional cornerstones of ground combat vehicles. In addition, the operations simulation interface returns data structures from GroundWars to the control system and user interface.

Figure 6:
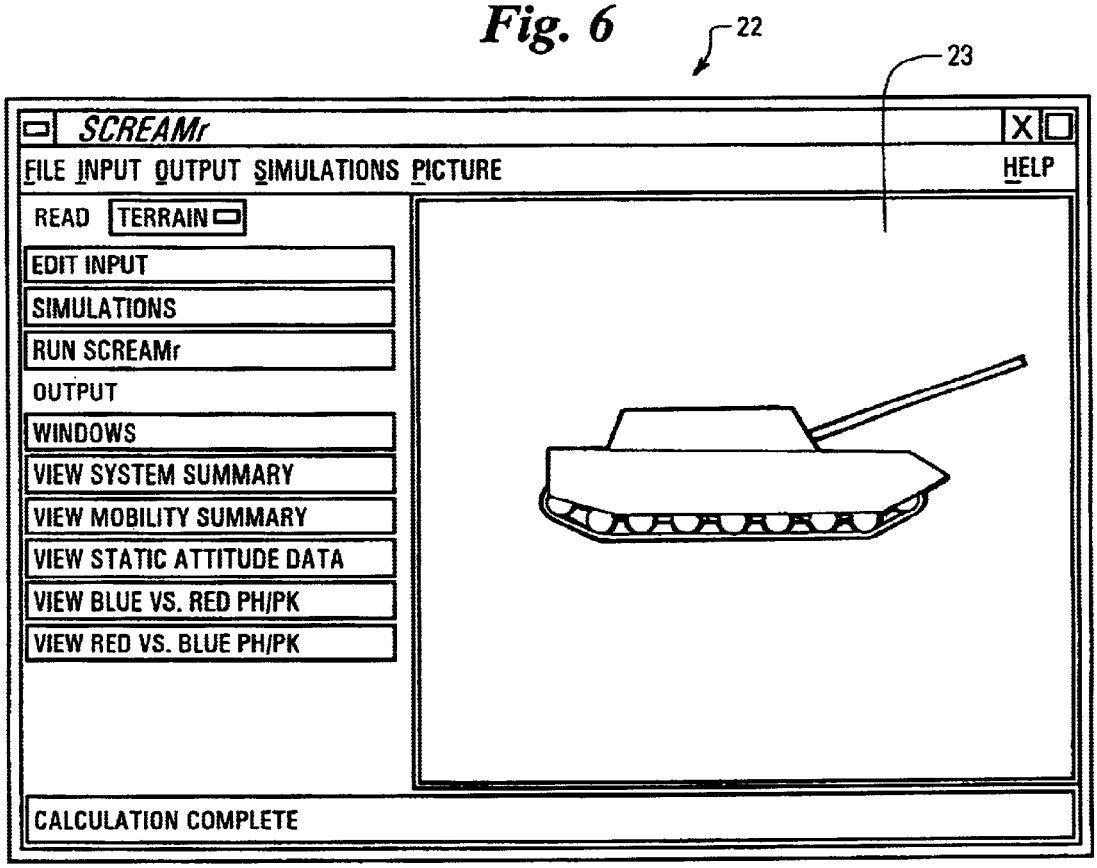
FIG. 6 is an illustration of the main menu window demonstrating the quickview window feature.
Figure 7:
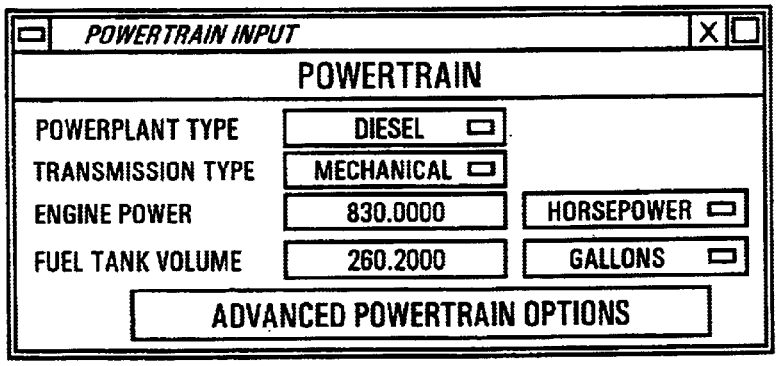
FIGS. 7 through 12 are illustrations of various menu windows of one embodiment relating to a ground combat vehicle.
Figure 8:
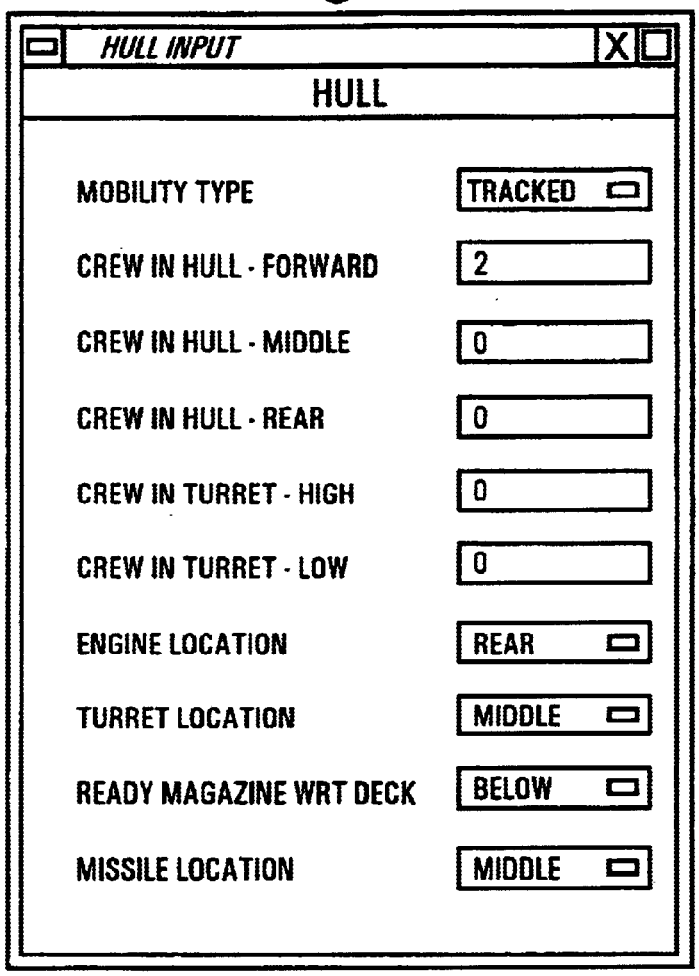
Figure 9:
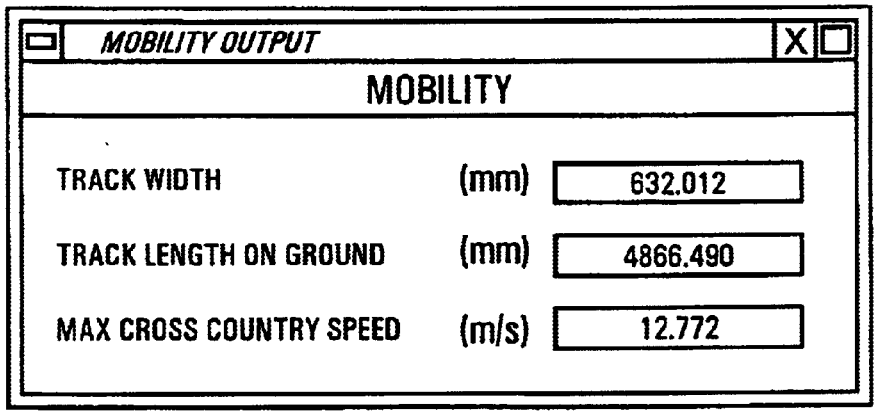
Figure 10:
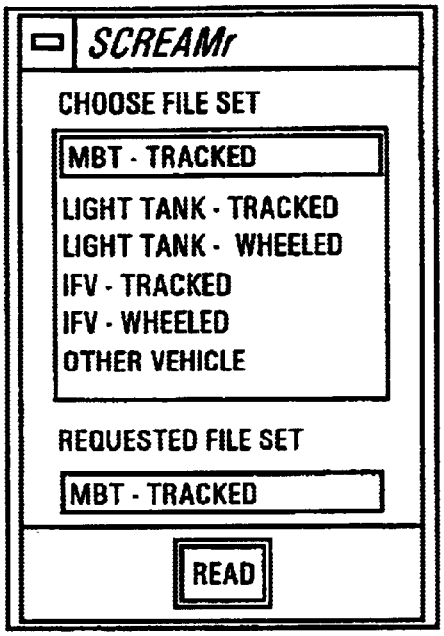
Figure 11:
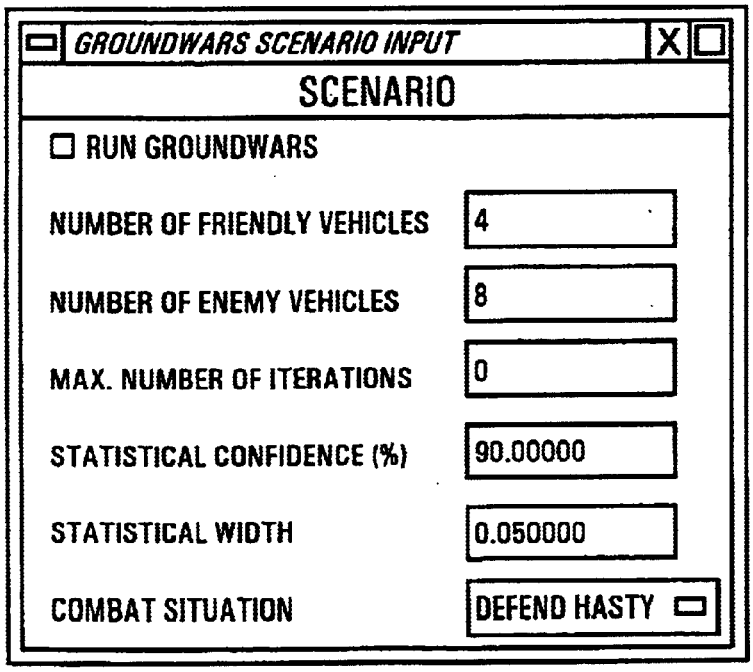

As those skilled in the art are aware, a multitude of graphical user interface designs are possible for inputting data and presenting resulting information. FIGS. 5 through 12 depict several of the windows used in the ground combat vehicle embodiment. Of particular significance is the main menu window 22 illustrated in FIG. 5. The main menu window 22 provides the button for selecting the mode of operation and the button for starting a simulation. The main menu window 22 also provides a quickview window feature 23. As shown in FIG. 6, the quickview window 23 preferably displays a three-dimensional visual prototype of a vehicle virtual representation upon completion of a successful run by the causal network model. The three-dimensional visual prototype can be viewed from different perspectives using a mouse. Clicking and holding the center mouse button with the pointer on the quickview window 23 causes the three-dimensional visual prototype to zoom in and out. Clicking and holding the right mouse button with the pointer on the quickview window 23 causes the three-dimensional visual prototype to rotate. Double clicking on the quickview window 23 creates a new window next to the previous window, which stays intact until it is closed.

The causal network model, controller system, and the virtual simulation system interface integrally comprise what is commonly referred to as the computational engine of the ground combat vehicle embodiment. The computational engine calculates the dependent parameters of a vehicle design given specified input parameters. The computational engine accepts input from ASCII text input files, calculates the dimensions, mass, and locations of the components, determines the size and mass of the overall vehicle, and calculates ballistic and mobility performance information. The computational engine also selectively runs GroundWars, NRMM II, or ARTQUIK. For output, the computational engine preferably produces a set of files that contains all the calculated information about a vehicle and its performance, and produces a high-level system summary output file and a quickview file that can be used by the quickview window 23.

Figures 12, 13:
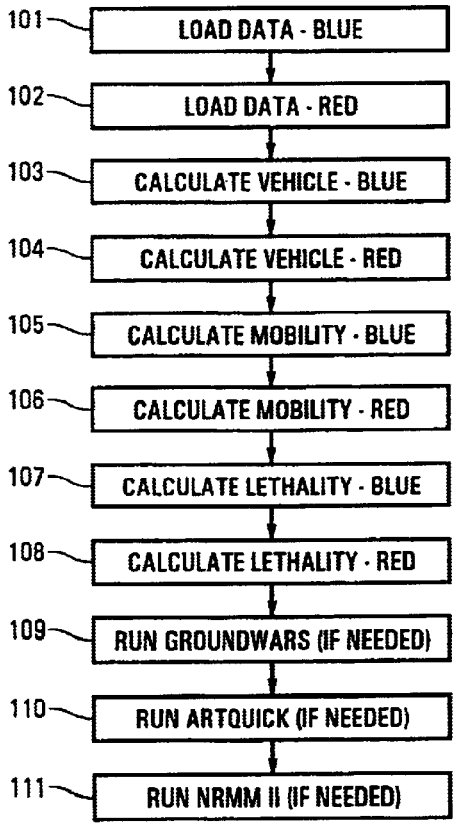
FIG. 13 is a diagram of the algorithm for the computational engine of the ground combat vehicle embodiment.

FIG. 13 illustrates an overall algorithm of the computational engine software. This algorithm is repeated each time the binary executable for the engine is run. Calculations for both a "blue" vehicle, the vehicle under consideration, and a "red" vehicle, the "threat" vehicle, are performed in the same way. They are both built from identically formatted input and both virtual representations use the same methods, so those skilled in the art are aware that the data loading and the calculations steps may be completed in other logical orders.

The text input files for a blue vehicle are written by either a user or the graphics user interface. The input files for a red vehicle are divided into a plurality of subdirectories, one for each threat vehicle available. For example, files are kept for the T55-type MBT, the T72-type MBT, the T90-type MBT, the Infantry Fighting Vehicle, and a supertank MBT. The Load Data—Blue 101 step loads the blue vehicle input files, and the Load Data—Red 102 step loads a set of red input files based on a user's selection. Input files include the following files: for ammunition, including information about the projectile and the propelling charge; for armor for the hull excluding the turret; for ARTQUIK scenario information for running the ARTQUIK model; for the cannon or a vehicle's main gun; for crew systems, including information about passengers such as how much space they use and how much they weigh; for the environment in which the vehicle is analyzed, including information such as air temperature and air density and terrain for running GroundWars scenarios; for vehicle fire control parameters; for information about a GroundWars scenario, such as how many platforms are on each side and what posture they are in; for any missiles a vehicle carries in addition to its main gun; for telling NRMM II whether to run or not; for details about a pulse forming network with respect to a vehicle with an electrothermal gun; for powertrain and other information about the engine and related components; for information about tracked suspension components; for information about wheeled suspension components; for describing the type of threat vehicle; for information about transportability constraints to which a vehicle is subject; for turret, information about the vehicle turret, including the turret armor and the elevation and depression of the gun; and for vehicle, information about the vehicle layout such as the number of crew, where the crew sits, and the location of major components such as the powerplant, turret, and magazine.

Figure 14:
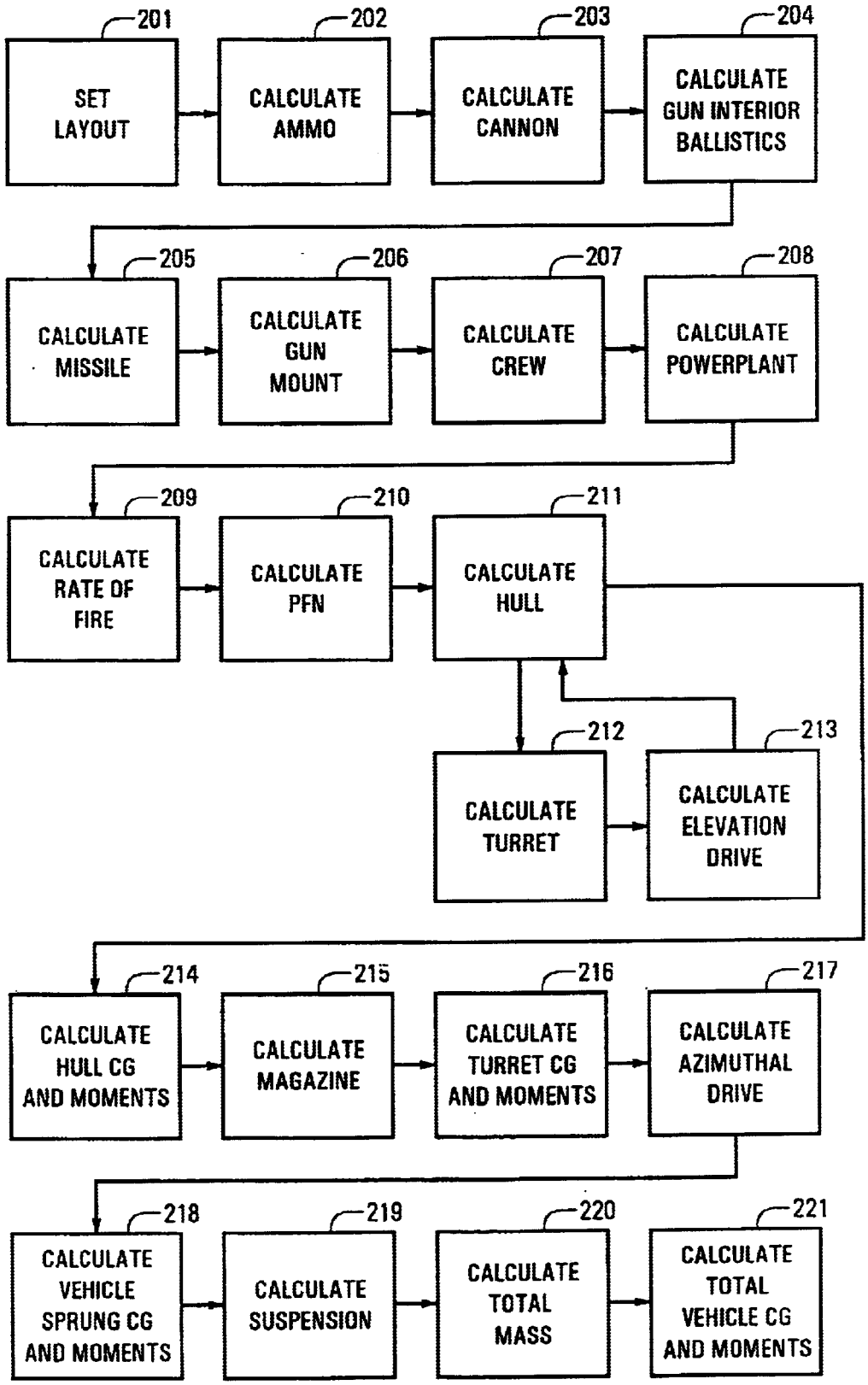
FIG. 14 is a diagram of the algorithm for calculating the parameters of a vehicle using the ground combat vehicle embodiment.

FIG. 14 illustrates a calculate vehicle—blue 103 step and a calculate vehicle—red 104 step, or the process by which a vehicle is calculated. Steps 202, 203, 205–208, 210–213, 215, 217, and 219 represent calculations for individual vehicle components. The other steps represent calculations for component properties or properties of the overall vehicle. The set layout 201 step establishes the layout of the vehicle. This includes determining the number of crew and where each crewmember is located, whether the engine is in the front or in the rear of the vehicle, whether the turret is in the mid or rear compartment of the vehicle, whether the ready magazine is located above or below the turret ring, and where any missiles are located. The algorithm that executes this step has internal logic that allows it to rule out any layouts the model cannot currently handle. For example, the engine and the turret cannot be in the same location. The calculate ammo 202 step is the first component calculation. The size of the ammunition is calculated before anything else since the size of a cannon is dependant on the size of the ammunition and the cannon size greatly influences the overall size of the vehicle. This step includes calculating the lethal area. The calculate cannon 203 step involves sizing a main gun based on the inputs for shot travel and maximum chamber pressure attained by the ammunition. The gun may be either autofrettaged or monoblock. Calculations are completed for both cases, and a monoblock gun is selected if it is less than 120% of the mass of a autofrettaged gun. Outputs from this calculation include the mass, length, radii of the barrel sections, moments of inertia, and center of mass of the cannon. Calculations of the ammunition and cannon properties generally are run prior to the interior ballistics function, and the interior ballistics function is completed before the gun mount is sized. The calculate gun interior ballistics 204 step calculates the muzzle velocity of both the HE (high Explosive) round and the APFSDS (armor piercing fin stabilized discarding sabot) round fired by the main gun. If the vehicle has missiles, the calculate missile 205 step calculates the size of the missile canister as well as performance parameters such as the average velocity of the missile. The calculate gun mount 206 step involves calculating the dimensions and mass of a gun mount, which is a function of the chamber diameter of the cannon. The dimensions of the gun mount will in turn influence the geometry of a turret. The calculate crew 207 step involves calculating the volume taken up by each crewmember and the center of mass of each crewmember. The overall dimensions and overall mass of the crewmembers are user inputs. Based on the engine and transmission type and other user input about the powertrain, the most critical of which is the engine horsepower, the calculate powerplant 208 step calculates the overall mass and volume claim of the powerplant. Based on the ammunition properties and the vehicle layout, the calculate rate of fire 209 step calculates the rate of fire of the main gun. The gun is assumed to be loaded automatically if there are two or fewer crew located in the turret; if there are three or more crew located in the turret, one of those crew is assumed to be a loader, and the gun is manually loaded. If the main gun is an electrothermal chemical gun, the size and mass of the associated pulse forming network are calculated in the calculate PFN 210 step. The size and shape of the hull can then be calculated in the calculate hull 211 step. The height of the hull may be influenced by some or all of the following factors: the height allowed for crew members in the hull, the minimum linear dimension of the powertrain components, the length of recoil of the cannon at maximum elevation, and the size of the ammunition. Once the height of the hull is fixed, it is possible to calculate the size of the turret. The turret basket radius, that part of the turret below the upper deck of the hull, may strongly influence the overall width and length of the hull. The calculation of the hull is temporarily suspended while the calculate turret 212 step is undertaken. Further, the calculate elevation drive 213 step is needed to complete the calculation of the turret. Once the size of the turret is determined, calculation of the size and mass of the hull can be completed.

At this point it is possible to calculate the center of gravity and moments of inertia of the hull structure in the calculate hull CG and moments 214 step.

The calculate magazine 215 step is used to determine the mass of the ready magazine. The dimensions of the magazine have already been calculated, as part of the turret. This may include a calculation for an autoloader, if present. Then it is possible to calculate the center of gravity and moments of inertia of the turret in the turret cg and moments 216 step. This includes all components that are fixed to and rotate with the turret, including crew members in the turret, the ready magazine, the main gun, the elevation drive, and the gun mount. Having calculated the azimuthal moment of inertia of the turret, it is possible to size the turret azimuthal drive in the calculate azimuthal drive 217 step. In the calculate vehicle sprung cg and moments 218 step, the combined center of mass and moments of inertia of the entire sprung part of the vehicle, everything but the suspension, is calculated. This includes the turret, the hull structure, and all hull interior components. The calculation for suspension, whether wheeled or tracked, is performed in the calculate suspension 219 step. This includes not just the mass of the suspension but also its vehicle dynamic properties. It is then possible to calculate the overall vehicle mass in the calculate total mass 220 step and the center of mass and moments of inertia of the entire vehicle, including both sprung and unsprung parts, in the calculate total vehicle cg and moments 221 step.

Figure 15:
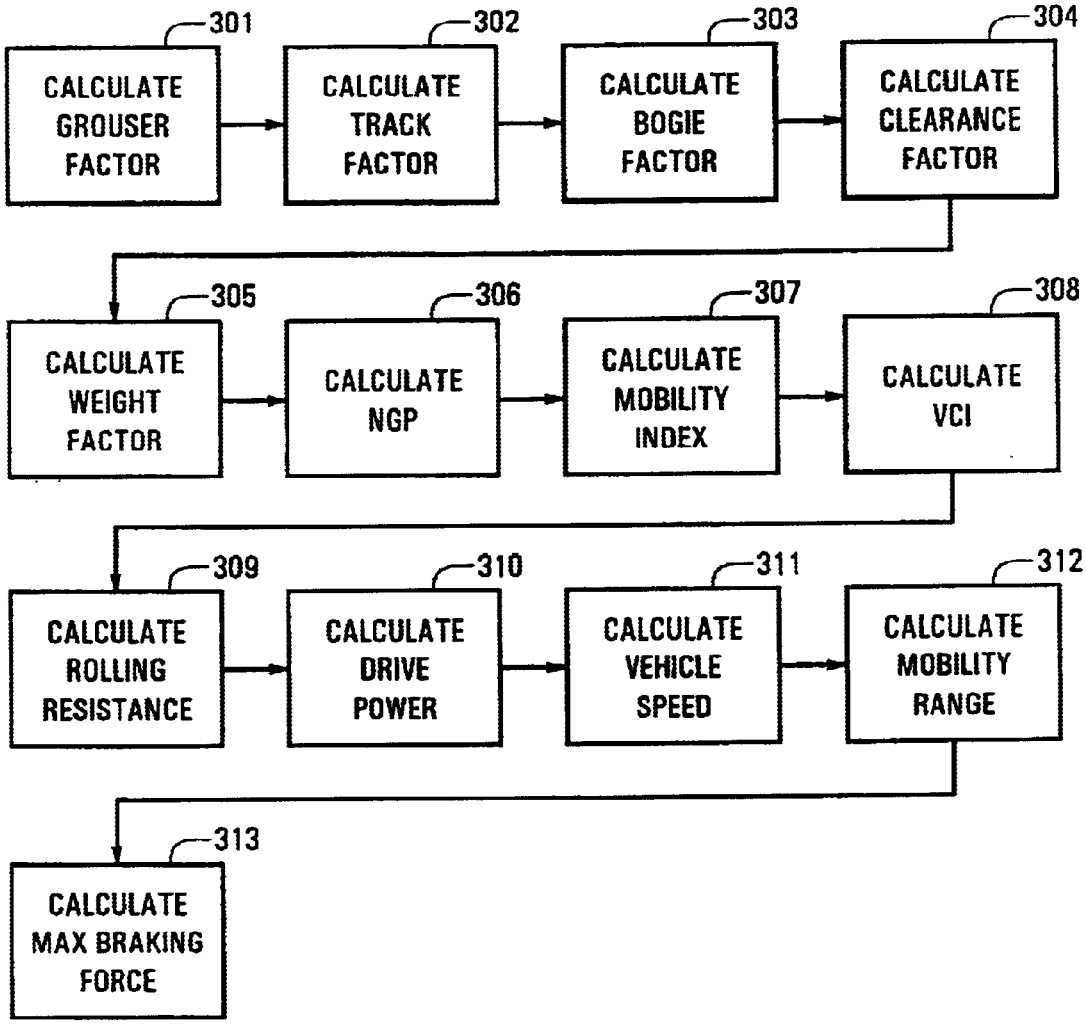
FIG. 15 is a diagram of the algorithm for calculating the vehicle mobility performance of a vehicle using the ground combat vehicle embodiment.

FIG. 15 illustrates a calculation of vehicle mobility performance parameters or the process by which the vehicle mobility performance is calculated. The calculate grouser factor 301 step, calculate track factor 302 step, transmission factor 303 step, calculate bogie factor 304 step, calculate clearance factor 305 step, calculate weight factor 306 step, and calculate nominal ground pressure 307 step are all used in calculating the mobility index. The grouser factor takes on discreet depending upon the running gear characteristics. The track factor, used only for tracked vehicles, is equal to the track width divided by 100, the transmission factor takes on a value of 1 for a hydraulic transmission and 1.05 for a mechanical transmission, and the bogie factor, also used only for tracked vehicles, is calculated by taking 10% of the weight of the vehicle, in pounds, and dividing by the track shoe areas and the total number of road wheels. The clearance factor is calculated by taking the vehicle ground clearance, in inches, and dividing by ten. The weight factor takes on discreet values based on the weight of the vehicle, and the nominal ground pressure, and preferably is used only for tracked vehicles. The weight factor is the average pressure applied to the soil by the vehicle, or the total weight divided by the total track area. The mobility index is then calculated in the calculate mobility index 308 step for use in calculating the vehicle cone index.

The calculate VCI 309 step calculates an empirical formula that uses the mobility index. The vehicle cone index is used in the vehicle's rolling resistance calculation. The calculate rolling resistance 310 step calculates the rolling resistance measure of the power required to overcome the internal resistance of the tracks and wheels and effects produced by their motion through the soil, measured in Hp/ton. Road values for tracked vehicles use a velocity dependent empirical expression that is incorporated into the speed calculation. The power which can be supplied to the sprocket (wheels) to propel a vehicle is calculated in the calculate drive power 311 step. It is based on the prime power, cooling and transmission efficiencies, thermal load, and required armament power. The calculate vehicle speed 312 step, the calculate mobility range 313 step, and the calculate max braking force 314 step, respectively, calculate the maximum vehicle speed given the available drive power, accounting for drag and rolling resistance; the maximum range that a vehicle can travel with a fuel supply fuel at maximum velocity; and, braking force based on an empirical relationship between braking force and mass for braking from 60 mph to 0 mph in 3 seconds.

Figure 16:
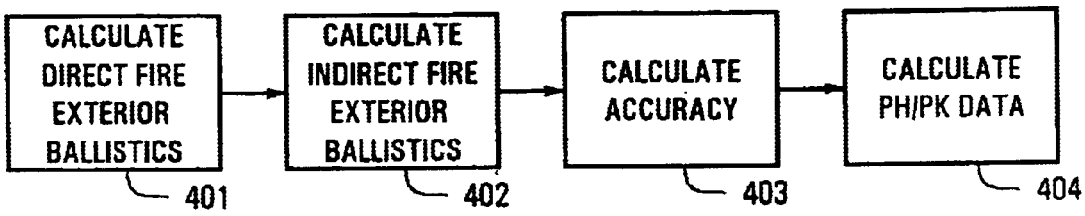
FIG. 16 is a diagram of the algorithm for calculating the vehicle lethality performance of a vehicle using the ground combat vehicle embodiment.

FIG. 16 illustrates a calculation of vehicle lethality performance parameters or the process by which the vehicle lethality performance is calculated. Lethality data is calculated subsequent to mobility data, because the maximum speeds of both the firing and the target platforms should be known before accuracy calculations can be made. The calculate direct fire exterior ballistics 401 step, based on the calculated muzzle velocity, flight characteristics of the direct fire projectile, presumed to be a long rod penetrator, and the atmospheric properties, calculates a set of direct fire ballistic data for range increments from 500 m to 8000 m. This step includes calculations for trajectory, time of flight, and velocity at impact. It also calculates the various unit effects for each trajectory, partial derivatives that measure the change in ballistic parameters given a small change in firing conditions such as change in range given a small change in cannon quadrant elevation. Given the muzzle velocity and maximum cannon elevation, a calculate indirect fire exterior ballistics 402 step calculates the maximum range attained by the indirect fire, or high explosive, projectile. Based upon the unit effects data calculated as part of the direct fire exterior ballistics step, combined with the fire control data input, the calculate accuracy 403 step calculates the random and variable elevation and azimuthal dispersions, measured in mils, for range increments from 500 m to 8000 m. This calculation is done for each of the four possible firer-target relative motion conditions, wherein the firer and the target are either stationary or moving. For each firer-target relative motion condition listed above, the calculate ph/pk 404 step calculates a set of probability of hit and probability of kill data. This data is based upon the dispersions calculated in the previous step. For a blue vehicle, the ph/pk data is evaluated with respect to the selected red (threat) vehicle. Additionally, ph/pk data is calculated for a red vehicle with a blue vehicle as the target, that can be interpreted as vulnerability information for a blue vehicle.

With the above information calculated, a user electively can run the GroundWars, ARTQUIK, or the NRMM II simulation models or systems in steps 109, 110, and 111. The measure of effectiveness in ARTQUIK is the number of rounds required to achieve the desired effect. If the vehicle does not carry enough ammunition to carry out the specified mission, the ground combat vehicle embodiment will report that the desired effect is inachievable. ARTQUIK is automatically run if the blue vehicle is carrying any high explosives type rounds on board.

Figure 17:
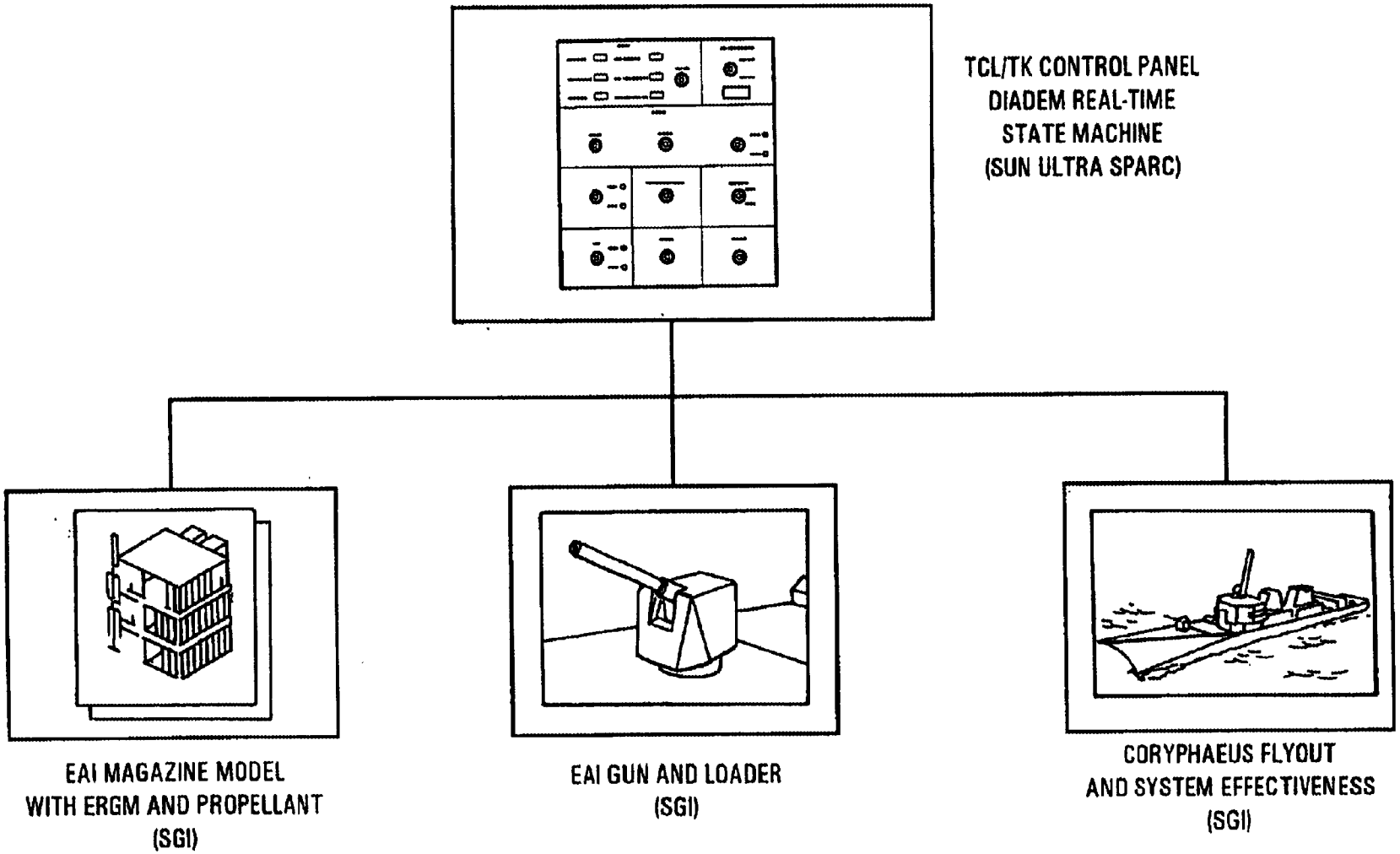
FIG. 17 is a depiction of various graphic user interface windows for another embodiment relating to a naval gun system.
Figure 18:
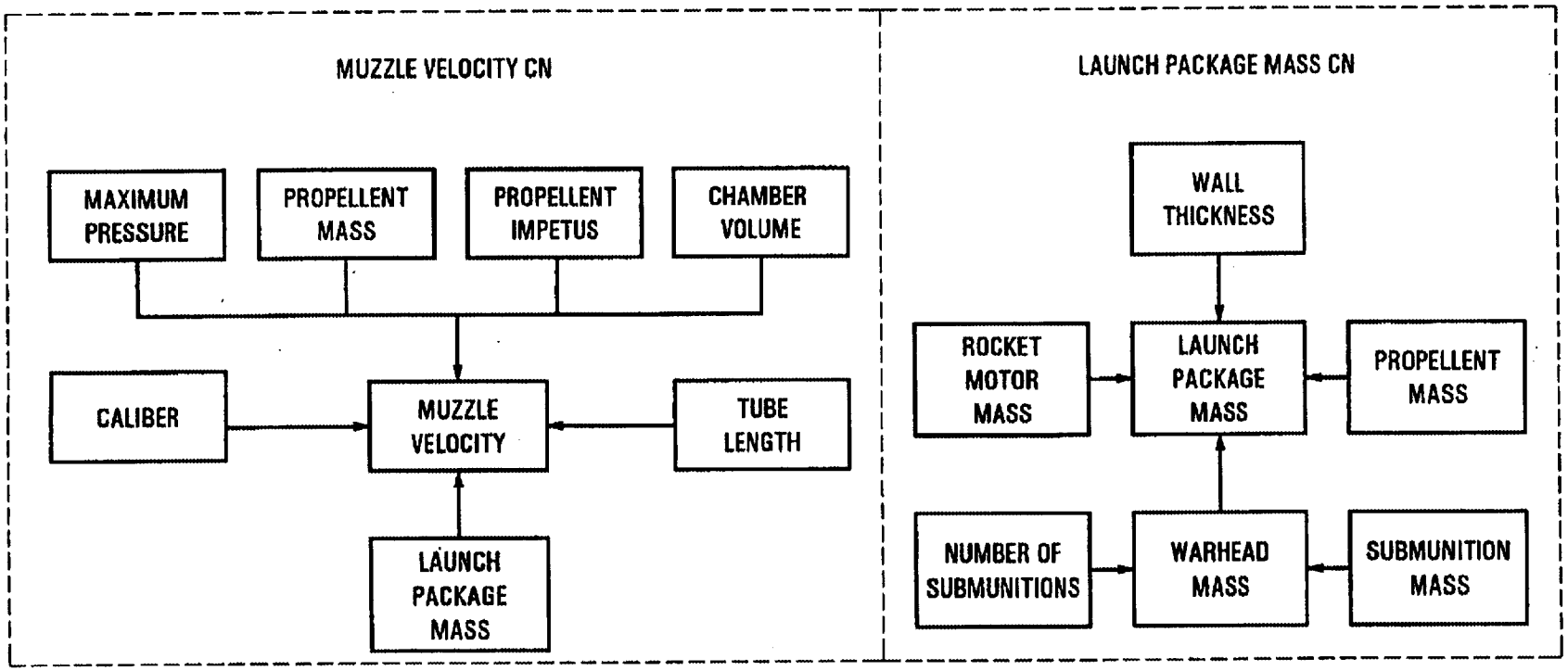
FIG. 18 is a diagram of those parts of the computational engine of the naval gun system embodiment for calcuating muzzle velocity and for calculating launch package mass.
Figure 19:
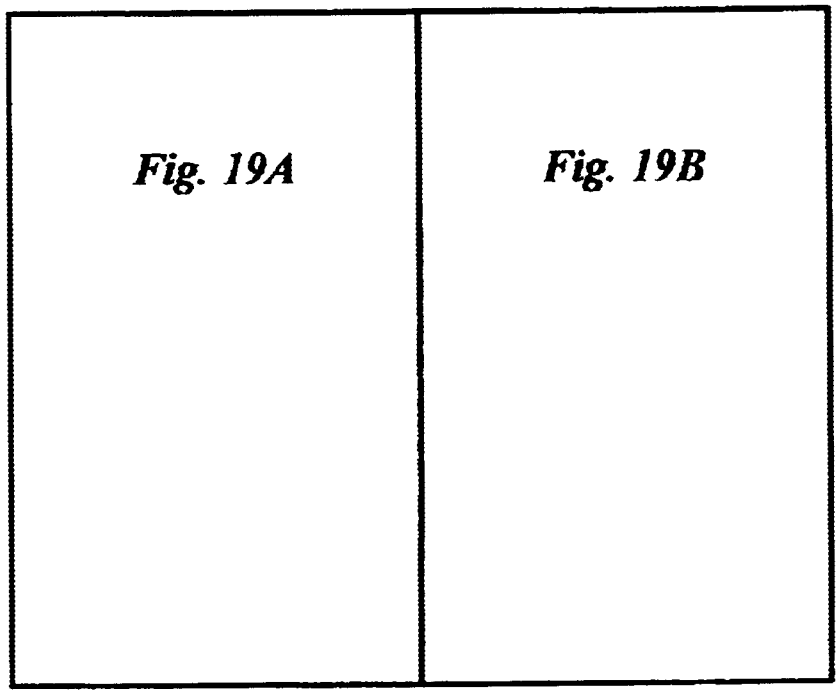
FIG. 19 is a diagram of the computational engine for the naval gun system embodiment
Figure 19A:
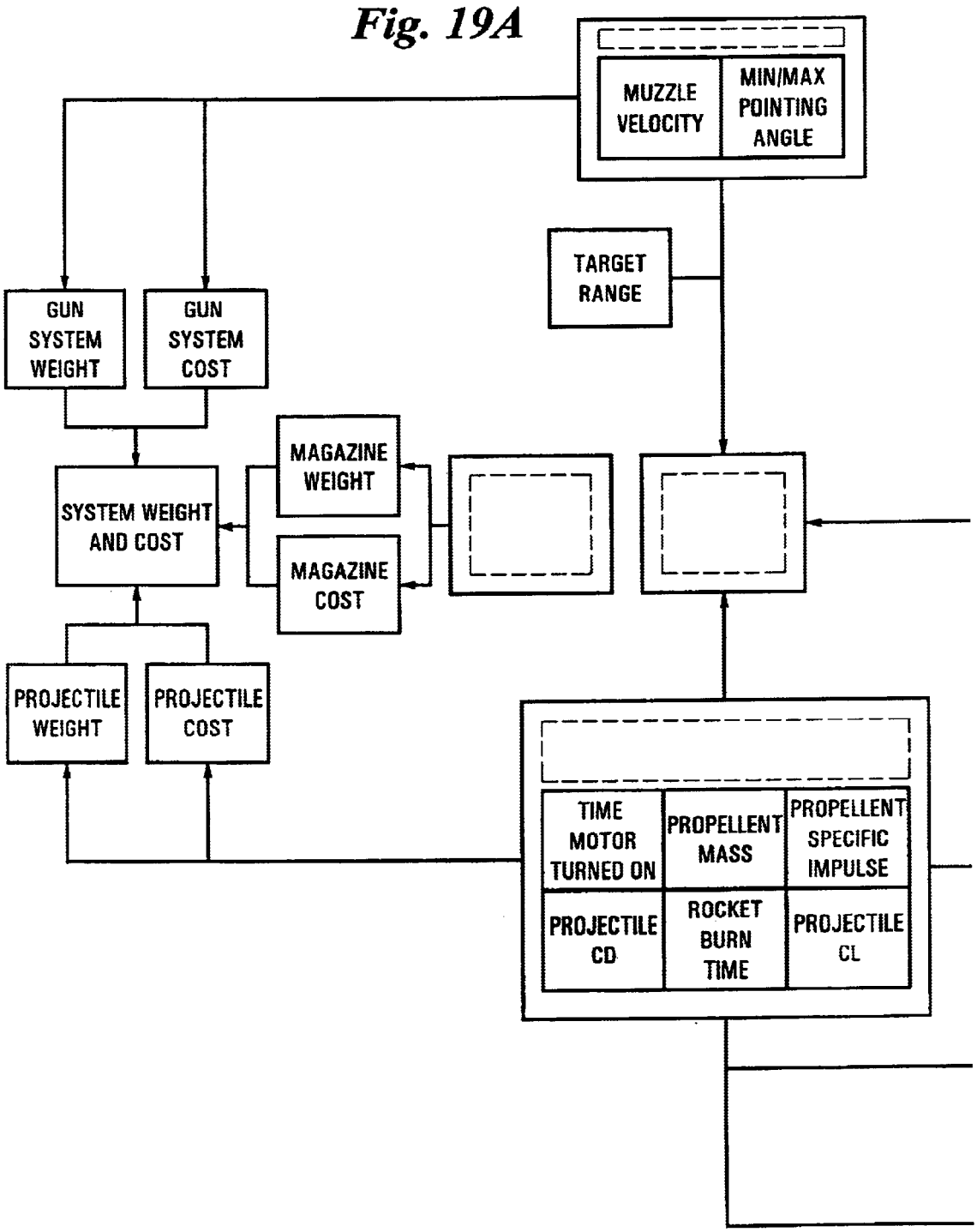
Figure 19B:
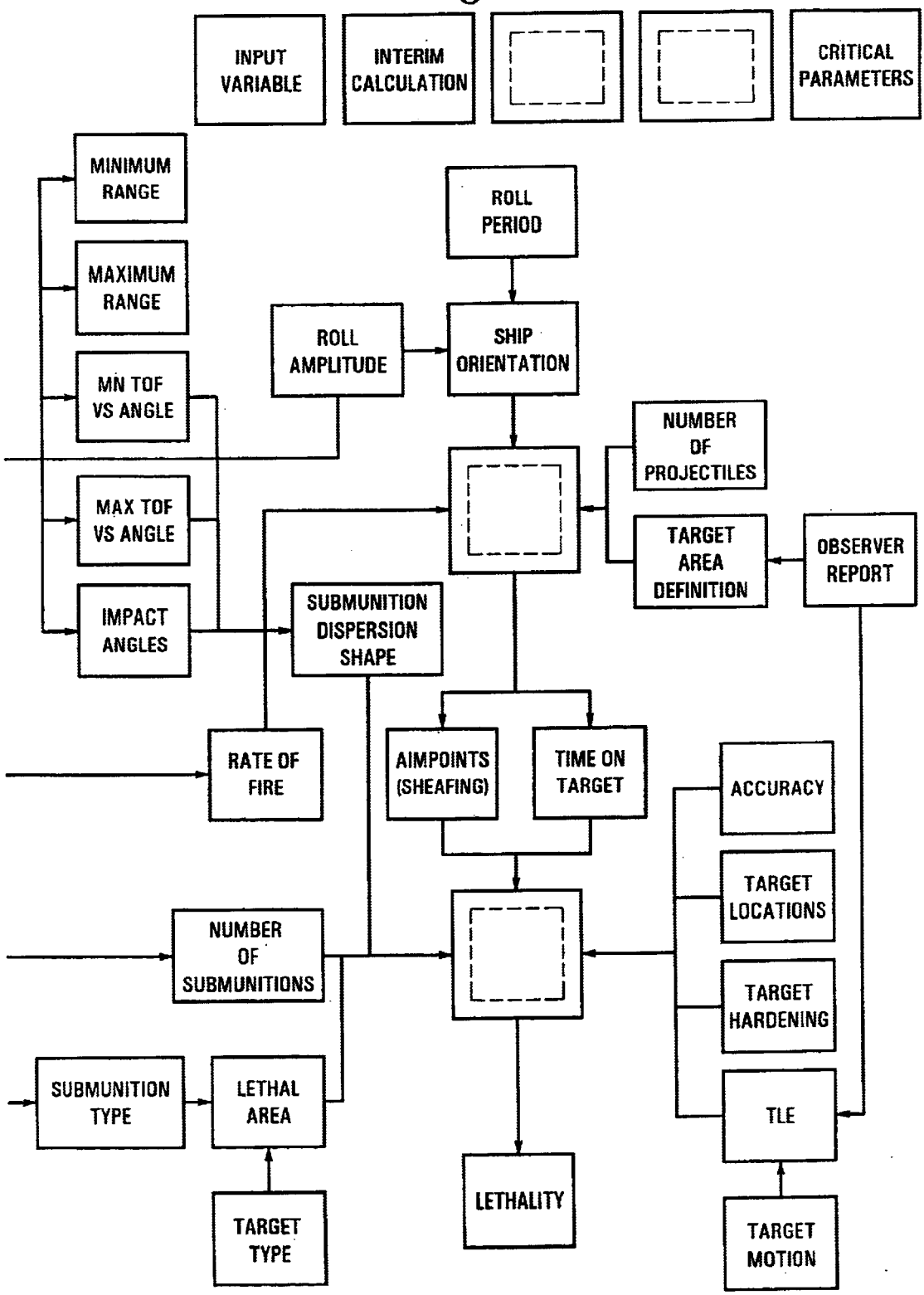
Figure 20:
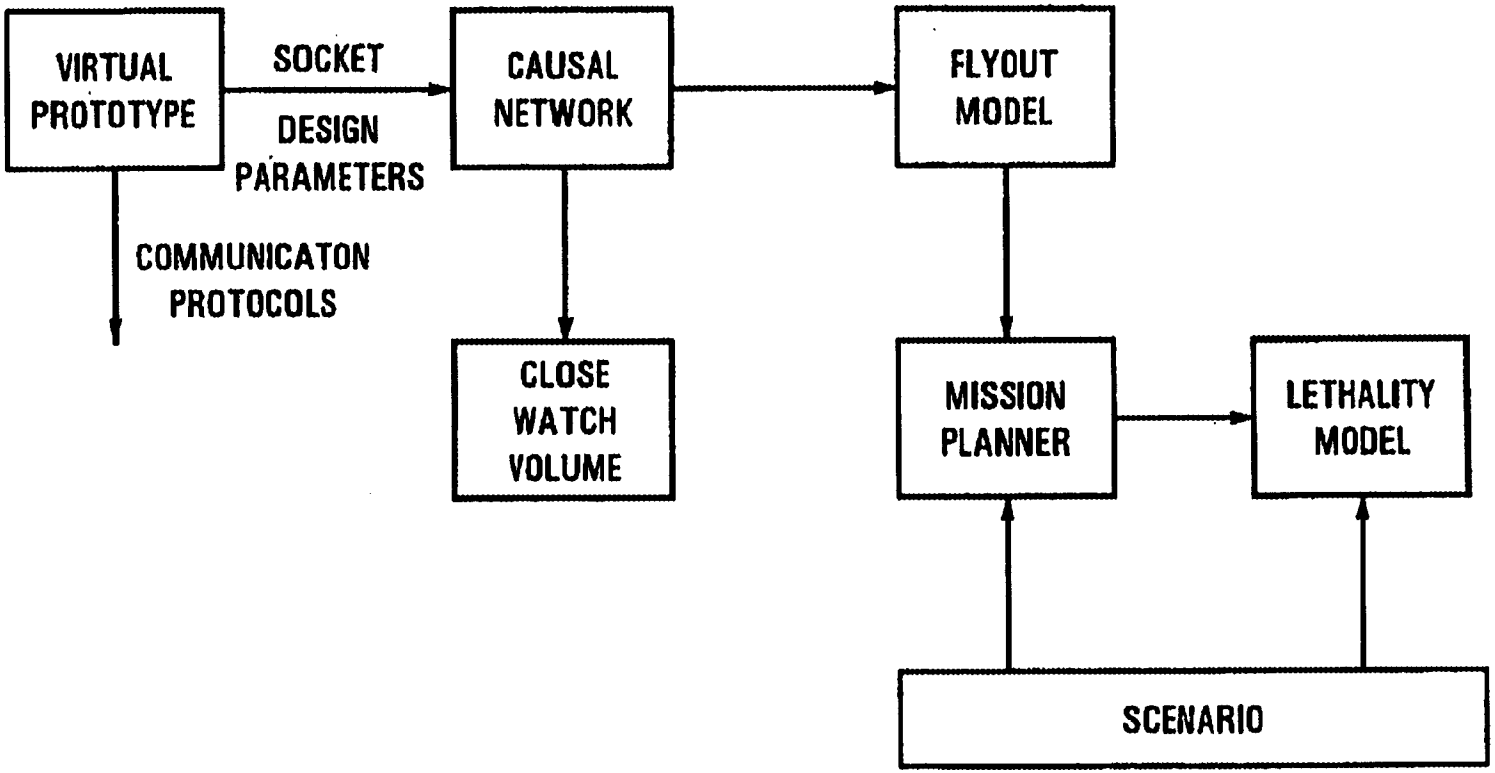
FIG. 20 is a diagram of the system architecture for the naval gun system embodiment.
Figure 21:
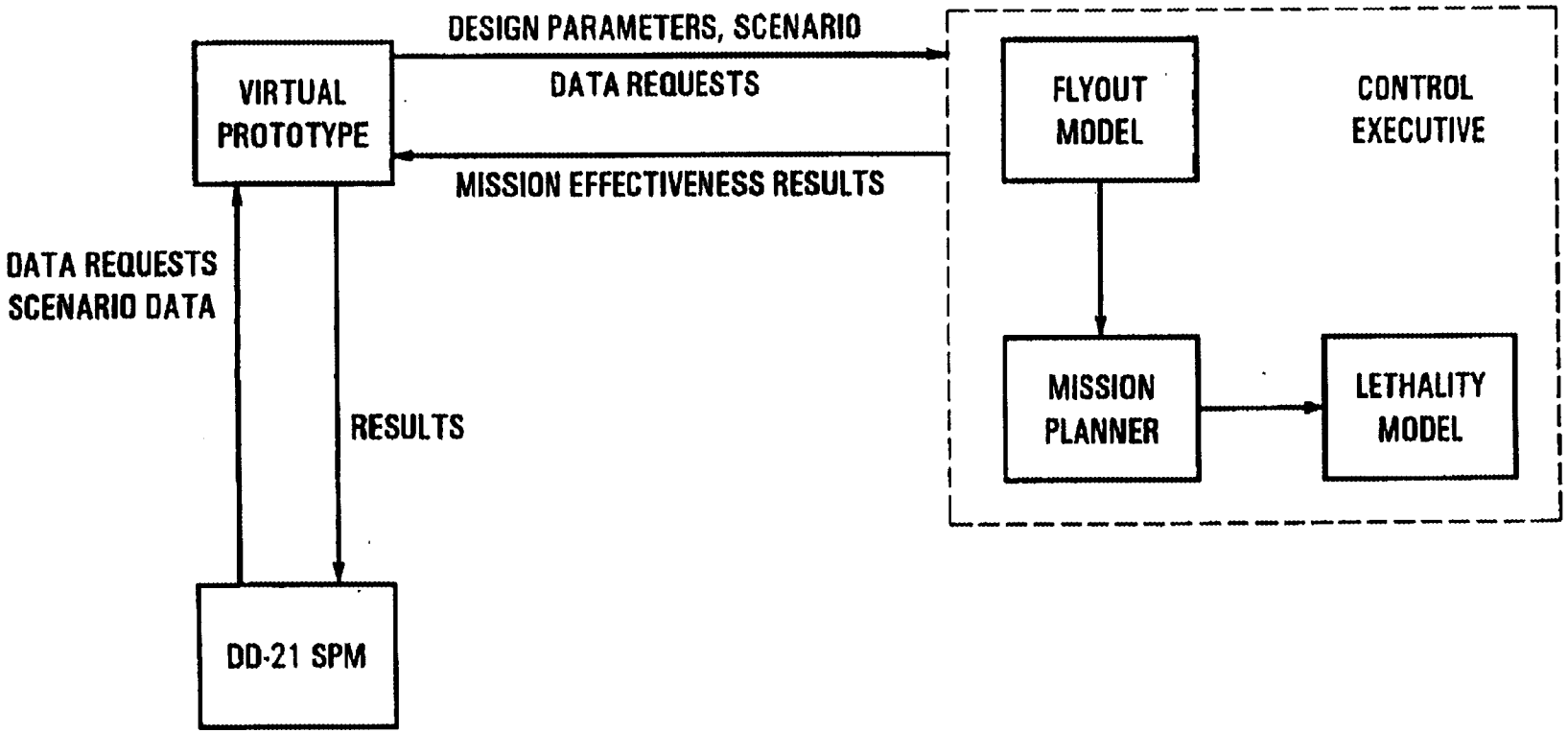
FIG. 21 is a diagram of a mature architecture of an integrated evaluation and simulation system of the naval gun system embodiment.

A second alternative embodiment implements an integrated evaluation and simulation system 410 for a naval gun system. Like the ground combat vehicle embodiment, the causal network model 440, controller system 450, and the virtual simulation system interface 430 integrally comprise what is commonly referred to as the computational engine of the naval gun system embodiment. FIG. 17 is a depiction of various graphic user interface windows 421 for the naval gun system embodiment. FIG. 18 is a diagram of those inputs used to calculate the launch package mass, which is used among other inputs to calculate the muzzle velocity. FIG. 19 is a general diagram of the computational engine of the naval gun system embodiment. As shown, dark blue boxes 470 indicate input variables, red boxes 472 indicate intermediate calculations, green boxes 474 indicate the primary model components, light blue boxes 476 indicate the causal network data segments, and purple boxes 478 indicate critical parameters. As those in the art are aware, other logical data and information flow patterns are possible that appropriately process data in the proper time sequence. FIG. 20 is a diagram of the system architecture for the naval gun system embodiment. Three virtual simulation systems are available for use by the naval embodiment, a flyout model, a mission planner, and a lethality model. FIG. 21 is a diagram of a mature architecture of integrated evaluation and simulation system 410. At this level, scenario and data requests can be made through the virtual representation or prototype, and the virtual representation or prototype provides all the parameters needed by a virtual simulation system. The causal network model is transformed into a controller for handling data flow and running a virtual simulation.

Although the preferred embodiment has been described herein, numerous changes and variations can be made and the scope of the present invention is intended to be defined by the claims herein.

What is claimed is:

1. An integrated evaluation and simulation system for a weapon system having a plurality of elements including at least one munition element, comprising:

a computer system programmed to implement a causal network model comprising an integrated collection of analysis models representing a model-based description of the weapon system at a subsystem and component level resolution, individual elements of the weapon system being configured as nodes in the casual network suited to model complex interactions and interrelationships with other nodes, including operational and lower-level requirements, system performance and design attributes, and constrained resources, each node including at least one dynamic parameter for creating a virtual representation of the weapon system, a control system operably coupled to said casual network, said control system adapted to control at least one state and at least one mode of operation of said interrated evaluation and simulation system and to control an optimization process that operates upon said casual network model, said mode including a single-run mode, a dependencies mode, and a sensitivities mode, said single run mode adapted to propagate selected inputs once through the casual network model to produce a set of intermediate and final results, the single run mode further adapted to provide for the changing of one or more of said selected inputs during operation;

said optimization process capable of determining a best set of design parameters that satisfy specified performance requirements and resource constraints, from among a set of user selected design parameters while causing an optimization of a weapon system's combat effectiveness as measured by loss exchange ratio computations, said dependencies mode, for rapidly and visually identifying at least one interrelationship between design attributes and performance parameters within the casual network model by providing for a display of performance parameters affected upon a change to a user selected input value;

said sensitivities mode adapted to evaluate weapon system performance in terms of one or more design parameters in the causal network model by providing for the evaluation of effects on one or more performance parameters upon varying a user selected design parameter;

at least one virtual simulation system operably coupled to said causal network model and said control system by a virtual simulation system interface, said virtual simulation system interface serving as a conduit between said causal network and said virtual simulation system, the virtual simulation system interface adapted to return data structures from the virtual simulation system to the control system, said virtual simulation system adapted to simulate said weapon system, including a simulation of a lethality of the at least one munition element; and a user interface operably coupled to at least said computer system to selectively input data into and receive information from, one or more of said causal network model, said control system and said virtual simulation system interface.

2. The system of claim 1, wherein said virtual simulation system comprises:

an operation simulator to simulate operations of said weapon system; and an effectiveness simulator to evaluate the effectiveness of said weapon system in a simulated operational environment.

3. The system of claim 1, wherein said control system includes an optimization routine that optimizes allocation of one or more selected constrained resources or design of one or more selected components or attributes of said weapon system by utilizing said causal network model.

4. The system of claim 3 wherein said optimization routine implements a gradient search methodology to optimize allocation of one or more selected constrained resources or design of one or more selected components or attributes of said weapon system.

5. The system of claim 3, wherein said optimization routine optimizes allocation of at least a cost of said weapon system and a weight of said weapon system.

6. The system of claim 1, wherein said user interface has a menu driven graphical user interface.

7. The system of claim 1, wherein said user interface visually displays a schematic diagram representing a model-based description of the weapon system at a subsystem and component level resolution, with individual elements of the weapon system depicted as nodes in the diagram, a connection between a first node and a second node describing said complex interactions and interrelationships between said pair of nodes, said diagram having commonality with said causal network model.

8. The system of claim 1, wherein said user interface displays data in a modular configuration of three-dimensional plots or numerical values or tables, each plot, value or table being associated with one of a plurality of components or attributes of said weapon system.

9. The system of claim 1, wherein said causal network model communicates with said virtual simulation system via a series of data arrays.

10. The system of claim 1, wherein said virtual simulation system is selected from a group of virtual simulation systems consisting of an accredited Ground War Combat Effectiveness model, an ARTOUIK model, and a NATO Reference Mobility Model II.

11. The system of claim 1, wherein said causal network model includes a relational database to store data that define at least one interrelationship between a plurality of parameters of said causal network model or an operational performance and at least one parameter of said causal network model.

12. The system of claim 1, wherein said causal network model has a modular implementation and each module is represented by a separate subroutine.

13. An integrated evaluation and simulation computer system for allocating resources across a system architecture of a weapon system having at least one munition element to optimize a combat effectiveness of said weapon system, said computer system comprising:

means for inputting data into and receiving information from said computer system including an interlinked configuration of a control system, and a computer system generated causal network model having a plurality of analysis models wherein individual elements of the weapon system are configured as nodes;

means for distributing data and information between said computer system and at least one virtual simulation system;

means for creating a virtual representation of an optimally effective weapon system by generating said causal network model of said weapon system representing individual elements of said weapon system as nodes having complex interactions and interrelationships with other nodes and that includes at least one dynamic parameter;

means for propagating selected inputs once through the causal network model in a single run mode to produce a set of intermediate and final results, the single run mode equipped with means for the changing of one or more of said selected inputs during operation;

means for determining a best set of design parameters that satisfy specified performance requirements and resource constraints, from among a set of user selected design parameters while causing an optimization of a weapon system's combat effectiveness as measured by loss exchange ratio computations, means for rapidly and visually identifying at least one interrelationship between design attributes and performance parameters within the causal network model by providing means for a display of performance parameters affected upon a change to a user selected input value; means for evaluating weapon system performance in terms of one or more design parameters in the causal network model by providing for the evaluation of effects on one or more performance parameters upon varying a user selected design parameter;

means for acquiring and using said intermediate and final results, said best set of design parameters and said interrelationship between said design attributes and performance parameters from said causal network to generate a virtual representation of an optimally effective weapon system; and means for displaying a graphical representation of said system.

14. In a computer system, a computer-readable storage media encoded with least executable program that operates as an integrated performance simulator for allocating resources across a system architecture of a weapon system having at least one munition element to optimize a combat effectiveness of said weapon system, said program comprising the step of:

a) generating a causal network model comprising an integrated collection of analysis models representing a model-based description of the weapon system at a subsystem and component level resolution, individual elements of the weapon system being configured as nodes in the causal network suited to model complex interactions and interrelationships with other nodes, including operational and lower-level requirements system performance and design attributes, and constrained resources, each node including at least one dynamic parameter for creating a virtual representation of the weapon system;

b) obtaining data necessary for said program to create a virtual representation of an optimally effective weapon system;

c) pulsing said causal network model to create said virtual representation of said optimally effective weapon system by;

d) propagating selected data once through the causal network model to produce a set of intermediate and final results;

e) determining a best set of design parameters that satisfy specified performance requirements and resource constraints, from among a set of user selected design parameters to cause an optimization of a weapon system's combat effectiveness as measured by loss exchange ratio commutators;

f) identifying at least one interrelationship between user specified design attributes and performance parameters within the causal network model by providing a display of performance parameters affected upon a change to a user selected input value;

g) computing an effect on one or more user specified performance parameters once varying a user selected design parameter;

h) selectively sending said virtual representation to a virtual simulation system for simulating weapon system operations; and i) receiving information about the performance of said weapons system.

* * * * *

UNITED STATES PATENT AND TRADEMARK OFFICE

CERTIFICATE OF CORRECTION

PATENT NO. : 6,945,780 B2
DATED : September 20, 2005
INVENTOR(S) : Perry

It is certified that error appears in the above-identified patent and that said Letters Patent is hereby corrected as shown below:

Column 5,
Line 47, after “embodiment” insert -- . --.

Column 12,
Line 11, delete “dependant” and insert -- dependent --.
Line 19, delete “a” and insert -- an --.
Lines 55-56, delete “crew member” and insert -- crewmember --.

Column 13,
Line 11, delete “crew member” and insert -- crewmember --.

Column 15,
Line 42, delete “interrated” and insert -- integrated --.

Column 18,
Line 4, after “with” insert -- at --.
Line 17, after “requirements” insert -- , --.
Line 37, delete “commutators;” and insert -- computations; --.
Line 40, after “providing” insert -- for --.

Signed and Sealed this

Twenty-first Day of February, 2006

JON W. DUDAS
*Director of the United States Patent and Trademark Office*